US005344246A

United States Patent [19]

Imoto et al.

[11] Patent Number: 5,344,246

[45] Date of Patent: Sep. 6, 1994

[54] PRINTER HAVING A VIBRATING PLATEN

[75] Inventors: Yasuo Imoto; Akira Iriguchi, both of Nagoya; Atsuo Sakaida, Gifu; Yasuji Chikaoka, Aichi; Akira Ninomiya, Nagoya, all of Japan

[73] Assignee: Brother Kogyo Kabushiki Kaisha, Nagoya, Japan

[21] Appl. No.: 997,077

[22] Filed: Dec. 29, 1992

[30] Foreign Application Priority Data

Jan. 9, 1992 [JP] Japan ..... 4-021878
May 29, 1992 [JP] Japan ..... 4-164196
Jun. 3, 1992 [JP] Japan ..... 4-170178

[51] Int. Cl.[5] ..... B41J 11/14

[52] U.S. Cl. ..... 400/552; 400/649; 400/652; 400/662

[58] Field of Search ..... 400/552, 320.1, 553, 400/649, 652, 659, 662

[56] References Cited

U.S. PATENT DOCUMENTS 4,532,525 7/1985 Takahashi ..... 400/120
4,538,932 9/1985 Takenoya ..... 400/662
4,560,296 12/1985 Hanyu ..... 400/649
4,603,988 8/1986 Takenoya ..... 400/662
4,611,940 9/1986 Takenoya ..... 400/662
4,623,275 11/1986 Hanyu et al. ..... 400/662
4,627,755 12/1986 Moriyama et al. ..... 400/662
4,929,106 5/1990 Buan et al. ..... 400/649
5,051,008 9/1991 Honda et al. ..... 400/56

FOREIGN PATENT DOCUMENTS 56-41429 9/1981 Japan .
1-195060 8/1989 Japan .

*Primary Examiner*—Edgar S. Burr
*Assistant Examiner*—John S. Hilten
*Attorney, Agent, or Firm*—Oliff & Berridge

[57] ABSTRACT

A printer for recording information on one of opposite surfaces of a recording medium, including a recording head displaceable along the one surface of the recording medium, for recording the information on the one surface, a platen device for defining a platen surface which is opposed to the recording head, a vibration device for applying vibration to the platen means and thereby vibrating the platen surface, and an actuating device for, when the recording head is displaced along the one surface of the recording medium, displacing the platen device along the other of the opposite surfaces of the recording medium in a same direction as a direction of the displacement of the recording head and in synchronism with the displacement of the recording head, so that the platen surface continues to be opposed to the recording head. The printer may further include a preventing device for preventing the platen surface from vibrating in a direction different from the vibration direction intersecting an operative surface of the recording head, or a deciding device for deciding whether to operate the vibration device to apply vibration to the platen device. The platen device may include at least one protruding portion protruding from the platen surface toward the recording head.

35 Claims, 16 Drawing Sheets

PRINTER HAVING A VIBRATING PLATEN

CROSS-REFERENCE TO RELATED APPLICATIONS

The claimed foreign priority is based on the complete specifications of Japanese Patents 4-21878 filed Jan. 9, 1992, 4-164196 filed May 29, 1992 and 4-170178 filed Jun. 03, 1992 for such subject matter not disclosed in provisional Japanese Patent U.M. 3-87301 filed Sep. 30, 1991.

BACKGROUND OF THE INVENTION

1. Field of the Invention

The present invention generally relates to a printer and particularly to improvements of a platen of the printer.

2. Related Art Statement

There is known a serial printer, such as a serial dot printer, which includes (a) a recording head which is displaceable along one of opposite surfaces of a recording medium, such as a multiple-sheet recording medium consisting of a set of superposed recording sheets, and (b) a platen which is opposed to the recording head via the recording medium positioned therebetween.

In a serial dot printer, such a multiple-sheet recording medium is used which includes a non-copying, top sheet and one or more copying sheets on which the top sheet is provided and on each of which a copy of an original being recorded on the top sheet is produced simultaneously with the recording of the original. The copying sheets are, for example, a pressure sensitive sheet, or a carbon-copying sheet on which a carbon copy is produced using a carbon paper or layer interposed between the top sheet and the copying sheet. However, the greater the number of the superposed sheets of a multiple-sheet recording medium is, the more difficult it is to produce a clear copy on every copying sheet down to the sheet or sheets at the bottom of the recording medium.

If the serial dot printer is modified to cause the dot recording wires of a recording head thereof to impact with increased force against the multiple-sheet recording medium, one or more holes might be opened through the top sheet of the recording medium, or the top sheet might even be torn. Conversely, if the wires of the recording head are adapted to impact with reduced force against the recording medium, the reduced impact force might not be transmitted down to the copying sheet or sheets at the bottom of the recording medium, so that an unclear copy may be produced on the bottom sheet or sheets.

In the first case where the increased impact force of the recording head is used for effecting recording on the recording medium, noise is increased, which causes people around the printer to feel discomfort. In addition, the printer needs to employ such a platen which is proof against the increased impact force, which leads to enlarging the size of the printer as a whole.

In the above described background, Japanese Patent Application laid open for opposition under Publication No. 56(1981)-41429 disclosed an impact printer which includes a recording head and a platen which is opposed to the recording head via a recording medium positioned therebetween. The Japanese document states that, when the recording head impacts against the platen for effecting recording on the recording medium, an ultrasonic vibrator or a high-frequency electric power source (in the latter case, is a piezoelectric element is provided in the platen) operated for vibrating the platen at a high frequency.

In the impact printer, the vibration force of the platen is applied to a recording medium in addition to the impact force of the recording head, so that a clear copy may be produced on every copying sheet included in a multiple-sheet recording medium. In addition, since the impact force of the recording head need not be increased, the printer does not increase noise and therefore does not cause people to feel discomfort.

However, in the prior printer, the platen is not displaceable, and the entire platen or respective portions of the same is/are vibrated at high frequencies. Thus, the printer consumes excessively large amount of energy for vibrating the platen, and therefore vibrating the platen costs very high. In addition, since the printer needs to employ the vibrator or the electric power, the size of the printer as a whole is adversely increased.

Furthermore, in the case where a piezoelectric element consisting of stacked piezoelectric ceramic layers (these layers are adhered to one another) is used as an ultrasonic vibrator for vibrating a platen of a printer, flexural or bending vibration may be applied to the element in a direction perpendicular to the direction of stacking of the ceramic layers (hereinafter, referred to as the "layer-stack direction"). The bending vibration is applied to the piezoelectric element for the following reasons: First, one of the opposite ends of the piezoelectric element as viewed in the layer-stack direction thereof is fixed, and the other end of the element is allowed to vibrate, i.e., expand and contract in the layer-stack direction thereof. Second, a platen surface to which the other end of the piezoelectric element is connected may slightly be slanted with respect to an operative surface of a recording head of the printer, when the element is assembled with the platen. Third, the operative surface of the recording head may be slanted with respect to the platen surface, when the recording head is displaced along a recording surface of a recording medium. Fourth, the operative surface of the recording head may impact against the platen surface in a direction slanted with respect to the platen surface, depending upon characters or other image patterns to be recorded on the recording medium. For the above reasons, the impact force of the recording head may be applied in a direction slanted with respect to the platen surface, and therefore some component of the impact force (i.e., bending vibration) may be applied to the piezoelectric element in a direction perpendicular to the layer-stack direction thereof. Thus, tensile stress may be produced in an outer arcuate (i.e., elongated) portion of a curved part of the stacked ceramic layers of the piezoelectric element, so that peeling may occur between the ceramic layers in the elongated portion of the element and therefore that the element may not vibrate normally, i.e., may vibrate in directions different from the direction perpendicular to the operative surface of the recording head. In an extreme case, the piezoelectric element may break so that it may fail to vibrate the platen surface.

SUMMARY OF THE INVENTION

It is therefore an object of the present invention to provide a printer which produces a clear copy on every copying sheet included in a multiple-sheet recording medium, by using a low impact force of a recording head and minimizing noise generated thereby.

The above object has been achieved by the present invention. According to a first aspect of the present invention, a printer for recording information on one of opposite surfaces of a recording medium, comprising (A) a recording head displaceable along the one surface of the recording medium, for recording the information on the one surface, (B) platen means for defining a platen surface which is opposed to the recording head, (C) vibration means for applying vibration to the platen means and thereby vibrating the platen surface, and (D) actuating means for, when the recording head is displaced along the one surface of the recording medium, displacing the platen means along the other of the opposite surfaces of the recording medium in a same direction as a direction of the displacement of the recording head and in synchronism with the displacement of the recording head, so that the platen surface continues to be opposed to the recording head.

In the printer constructed as described above, recording is effected on a recording surface of a recording medium, as the recording head is displaced along the recording surface. When the recording head is moved along the recording medium, vibration is applied to the platen means. When the impact force of the recording head is being applied to the recording medium, the platen surface of the platen means applies vibration to the recording medium. Thus, even in the event that the recording medium is, for example, a multiple-sheet recording medium consisting of a set of superposed recording sheets, a clear copy is produced, with a sufficiently low impact force of the recording head, on every recording sheet from the top sheet down to the bottom sheet in the recording medium, without opening a hole or holes in the top sheet or tearing the top sheet. Since the impact force of the recording head is sufficiently low, no uncomfortable noise is generated when recording is effected by the printer.

In addition, when the recording head is displaced along the recording medium, the platen is also displaced in the same direction as the direction in which the recording head is moved. Therefore, the size and weight of the platen means is minimized. Since the size of the printer as a whole is thus minimized, the printer is manufactured at remarkably reduced cost. Moreover, the platen means advantageously is vibrated with reduced amount of energy.

It is another object of the present invention to provide a printer which includes a piezoelectric element to vibrate a platen surface and prevents the piezoelectric element from being subjected to bending vibration and therefore from suffering from peeling or breakage.

The above indicated, second object has been achieved by the present invention. According to a second aspect of the present invention, there is provided a printer for recording information on one of opposite surfaces of a recording medium, comprising (i) a recording head for recording the information on the one surface of the recording medium, (ii) a platen member having a platen surface which is opposed to an operative surface of the recording head, (iii) a piezoelectric element which vibrates upon application thereto of an electric voltage, the piezoelectric element being connected to the platen member, so that the vibration of the piezoelectric element is transmitted to the platen member so as to vibrate the platen surface in a vibration direction intersecting the operative surface of the recording head, and (iv) preventing means for preventing the platen member from vibrating in a direction different from the vibration direction.

In the printer constructed as described above, the platen surface effectively is prevented from vibrating in directions different from a direction preferably perpendicular to the operative surface of the recording head, when the piezoelectric element vibrates. Even if the impact force of recording wires of the recording head is applied in a direction slightly slanted with respect to the platen surface, depending upon characters or other image patterns to be recorded, the platen or platen surface is vibrated with stability in the direction perpendicular to the operative surface of the recording head. Thus, the piezoelectric element effectively is prevented from being subjected to bending vibration. In the case where the piezoelectric element consists of stacked piezoelectric ceramic layers, the element is effectively prevented from peeling between the ceramic layers or even breakage of the element.

It is yet another object of the present invention to provide a printer which includes a platen surface having at least one protruding portion and produces a clear copy on every copying sheet included in a multiple-sheet recording medium by using a low impact force of the recording head and thereby minimizing noise generated by the recording operation of the printer.

The above indicated, third object has been achieved by the present invention. According to a third aspect of the present invention, there is provided a printer for recording information on one of opposite surfaces of a recording medium, comprising (1) a recording head displaceable along the one surface of the recording medium, for recording the information on the one surface, (2) platen means for defining a platen surface which is opposed to the recording head, the platen means including at least one protruding portion protruding from the platen surface toward the recording head, and (3) actuating means for, when the recording head is displaced along the one surface of said recording medium, displacing the platen means along the other of the opposite surfaces of the recording medium in a same direction as a direction of the displacement of the recording head and in synchronism with the displacement of the recording head, so that the platen surface continues to be opposed to the recording head.

In the printer constructed as described above, the impact force of the recording head is applied to a recording surface of the recording medium, for effecting recording on the recording surface. Simultaneously, the reaction of the at least one protruding portion of the platen surface which reaction occurs in response to the impact of the recording head, is applied to a non-recording surface of the recording medium. That is, the recording medium is sandwiched between the recording head and the at least one protruding portion on the platen surface. Thus, the impact force of the recording head is not scattered or weakened, but is concentrated on a small area of the protruding portion on the platen surface. Therefore, in the event that a multiple-sheet recording medium consisting of, e.g., ten superposed sheets is used, a clear copy is obtained on every recording sheet down to the bottom sheet of the recording medium. In addition, since the recording operation is carried out using a low impact force of the recording head, the printer is free of the problem of generating noise which causes people to feel discomfort.

It is a further object of the present invention to provide a printer which includes vibration means for applying vibration to a platen surface and prevents the vibration means from operating for a recording medium consisting of a set of few (e.g., 2 to 5) superposed sheets or a single sheet, thereby reducing noise generated when the vibration means is vibrated.

The above object has been achieved by the present invention. According to a fourth aspect of the present invention, there is provided a printer for recording information on one of opposite surfaces of a recording medium, comprising (a) a recording head displaceable along the one surface of the recording medium, for recording the information on the one surface, (b) platen means for defining a platen surface which is opposed to the recording head, (c) vibration means for applying vibration to the platen means and thereby vibrating the platen surface, and (d) deciding means for deciding whether to operate the vibration means to apply the vibration to the platen means.

In the printer constructed as described above, the impact force of the recording head is applied to a recording surface of the recording medium, for effecting recording on the recording surface and, as needed, the vibration of the platen means is applied to a non-recording surface of the recording medium. Thus, the recording medium is sandwiched between the recording head and the platen surface of the platen means. Even in the case of use of a multiple- sheet recording medium including, in addition to a non-copying top sheet, e.g., nine copying sheets under the top sheet, a clear copy is produced on every copying sheet down to the bottom sheet. In addition, since the vibration means is operated only when appropriate, the printer is operable at reduced energy cost.

BRIEF DESCRIPTION OF THE DRAWINGS

The above and optional objects, features, and advantages of the present invention will better be understood by reading the following detailed description of the presently preferred embodiments of the invention when considered in conjunction with the accompanying drawings, in which.

DETAILED DESCRIPTION OF THE PREFERRED EMBODIMENTS

Figure 1:
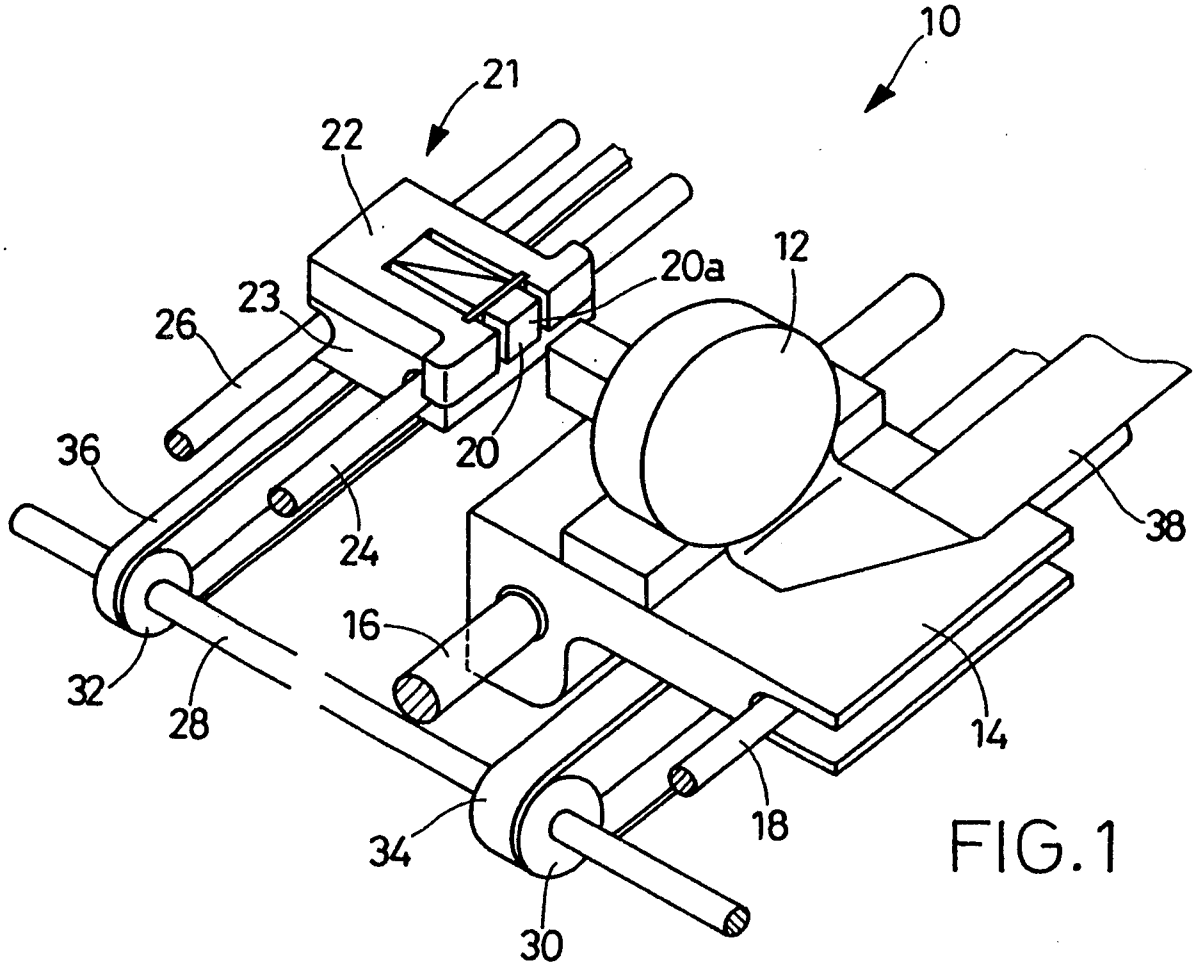
FIG. 1 is a perspective view of a part of a serial dot printer to which the present invention is applied.
Figure 2:
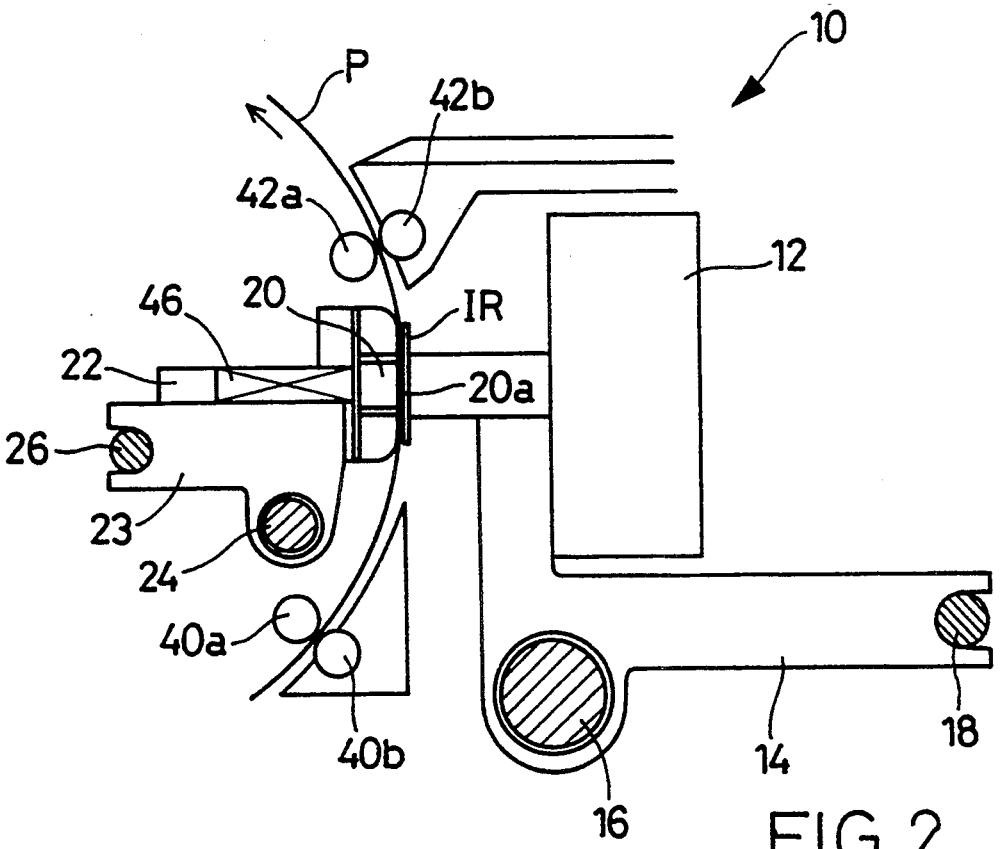
FIG. 2 is a cross-sectional view of the printer of FIG. 2.

Referring first to FIGS. 1 and 2, there is shown a serial dot printer 10 to which the present invention is applied. The printer 10 includes a recording head 12 which is supported by a first carriage 14. The first carriage 14 is supported on a first pair of guide shafts 16, 18, so that the recording head 12 is reciprocatable on, and along, the guide shafts 16, 18. The printer 10 further includes a platen device 21 which is supported by a second carriage 23. The platen device 21 includes a platen member 20, and a frame member 22 is supported on a second pair of guide shafts 24, 26, so that the platen device 21 is reciprocatable on, and along, the guide shafts 24, 26.

The first carriage 14 supporting the recording head 12 is fixed to a first timing (toothed) belt 34 which is engaged with, and stretched between, a first drive pulley 30 and a follower pulley (not shown) disposed spaced apart from the first drive pulley 30. Similarly, the second carriage 23 supporting the platen device 21 is fixed to a second timing (toothed) belt 36 which is engaged with, and stretched between, a second drive pulley 32 and a follower pulley (not shown) disposed spaced apart from the second drive pulley 32. The first and second drive pulleys 30, 32 have an equal outer diameter, and are fixed to a common drive shaft 28 which extends in a direction perpendicular to the direction of extension of the guide shafts 16, 18, 24, 26. The drive shaft 28 is connected to a drive motor (not shown), so that each drive pulley 30, 32 is rotated when the drive shaft 28 is rotated by the drive motor.

A flexible circuit 38 is connected to the recording head 12, so that recording data is supplied to the recording head 12 via the flexible circuit 38.

As shown in FIG. 2, a multiple-sheet recording medium, P, consisting of a set of superposed recording sheets, is fed between the recording head 12 and the platen member 20, in a feeding direction indicated at arrow in the figure, by being nipped by, and between, a first pair of pinch rollers 40*a*, 40*b* disposed on an upstream side as viewed in the feeding direction and subsequently a second pair of pinch rollers 42*a*, 42*b* disposed on a downstream side of the feeding direction. The recording medium P includes a non-copying, top sheet and some (e.g., nine) copying sheets under the top sheet. A printing ribbon, IR, is positioned between the recording medium P and the recording head 12. When the recording head 12 impacts against a platen surface 20*a* of the platen member 20 via the copying ribbon IR and the recording medium P, an original image is recorded on the top sheet of the recording medium P and simultaneously a copy of the original image recorded on the top sheet is produced on each of the copying sheets under the top sheet. In the present embodiment, the original image is an ink image, since the ink adhered to the printing ribbon IR is transferred to the top sheet when the ribbon IR is impacted by the recording head 12. Meanwhile, a carbon copy is recorded on each copying sheet since carbon adhered to a carbon paper or layer interposed between the top sheet and each copying sheet is transferred to the each copying sheet.

Figure 3:
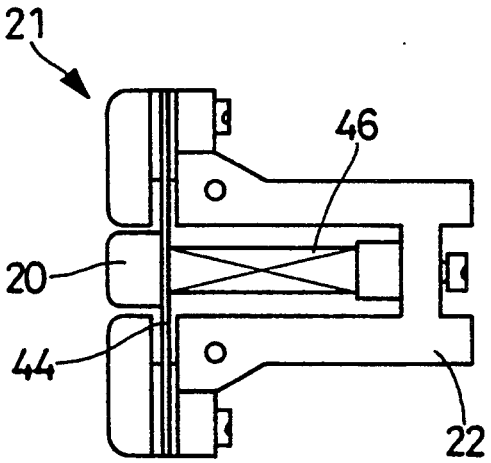
FIG. 3 is a plan view of a platen device employed in the printer of FIG. 1.

The platen device 21 is illustrated in detail in FIG. 3. A flat spring 44 is provided between the platen member 20 and the frame member 22. The platen member 20 is fixed to one of opposite surfaces of the flat spring 44, and a stacked piezoelectric element 46 is at one of opposite ends thereof to the other surface of the flat spring 44. The piezoelectric element 46 is at the other end thereof supported by the frame member 22. An electric power source (not shown) applies to the piezoelectric element 46 an ultrasonic alternating electric current which alternates at a frequency falling within an ultrasonic frequency range. Consequently, the piezoelectric element 46 vibrates, i.e., expands and contracts at an ultrasonic frequency. The ultrasonic vibration of the piezoelectric element 46 is transmitted to the platen member 20, so that the platen surface 20*a* vibrates in a direction substantially perpendicular to an operative surface of the recording head 12 in which surface the ends of the dot recording wires thereof are provided.

There will be described the recording operation of the serial dot printer 10 constructed as described above.

When a batch of recording data is fed to the reading head 12 via the flexible circuit 38 with the multiple-sheet recording medium P being set on the printer 10 as shown in FIG. 2, appropriate ones of the recording wires of the recording head 12 apply impact to the recording medium P via the printing ribbon IR, so as to record dots as information represented by the recording data.

In synchronism with times of feeding of respective batches of recording data to the recording head 12, the drive shaft 28 is rotated, so that the first carriage 14 is displaced along the recording medium P. Since the second carriage 23 supporting the platen device 21 is also connected to the drive shaft 28, the platen device 21 concurrently is displaced in the same direction as the direction of displacement of the recording head 12, such that the platen surface 20*a* continues to be opposed to the operative surface of the recording head 12. Since the outer diameters of the first and second drive pulleys 30, 32 are equal to each other, the rate or speed of the displacement of the platen device 21 is equal to that of the displacement of the recording head 12.

Upon application of an ultrasonic alternating electric current to the piezoelectric element 46, the piezoelectric element 46 vibrates at an ultrasonic frequency, and the ultrasonic vibration of the element 46 is transmitted to the platen member 20 via the flat spring 44. Thus, the platen surface 20*a* vibrates at the ultrasonic frequency. In the present embodiment, a time duration in which the recording head 12 directly applies impact or pressing force to the recording medium P for recording a dot on the medium P, is about 100 μsec. Therefore, in the case where an ultrasonic current of 30 KHz or 40 KHz is applied to the piezoelectric element 46, the platen surface 20*a* vibrates three or four times during the above indicated time duration for the one-dot recording operation.

When the recording head 12 is applying an impact force one time to the recording medium P, the platen member 20 vibrates more than one time. Thus, the recording medium P receives the repetitive vibration of the platen 20 in addition to the impact of the recording head 12, so that a clear image is provided on each of the superposed sheets of the recording medium P.

Figure 4:
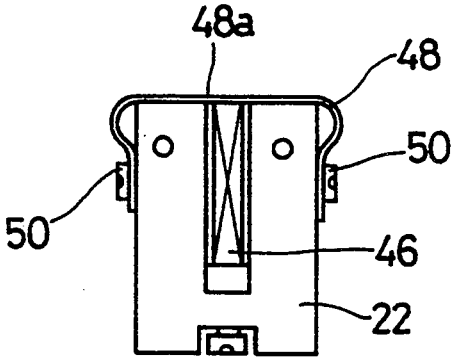
FIG. 4 is a plan view of a different platen device employed in the printer of FIG. 1.

FIG. 4 shows a different platen device which is employable in the serial dot printer 10. This platen device includes, in addition to a frame member 22, a flat spring 48 whose opposite end portions are bent and fixed to respective side surfaces of the frame member 22 with the help of screws 50, 50. One of opposite surfaces of the flat spring 48 serves as a platen surface 48*a*. A piezoelectric element 46 is fixed to the other surface of the flat spring 48. This platen device does not need an exclusive platen member like the platen member 20 shown in FIG. 3, since an intermediate portion of the flat spring 48 providing the platen surface 48*a* serves as a platen member.

In addition, in the platen device of FIG. 4, ultrasonic vibration of the piezoelectric element 46 is transmitted to a non-recording surface of a recording medium P via only the flat spring 48. This arrangement is advantageous in that the platen surface 48*a* exhibits improved response to the vibration of the piezoelectric element 46 and therefore that the recording or printing of dots on the recording medium P is effected with higher quality and reliability.

Figure 5:
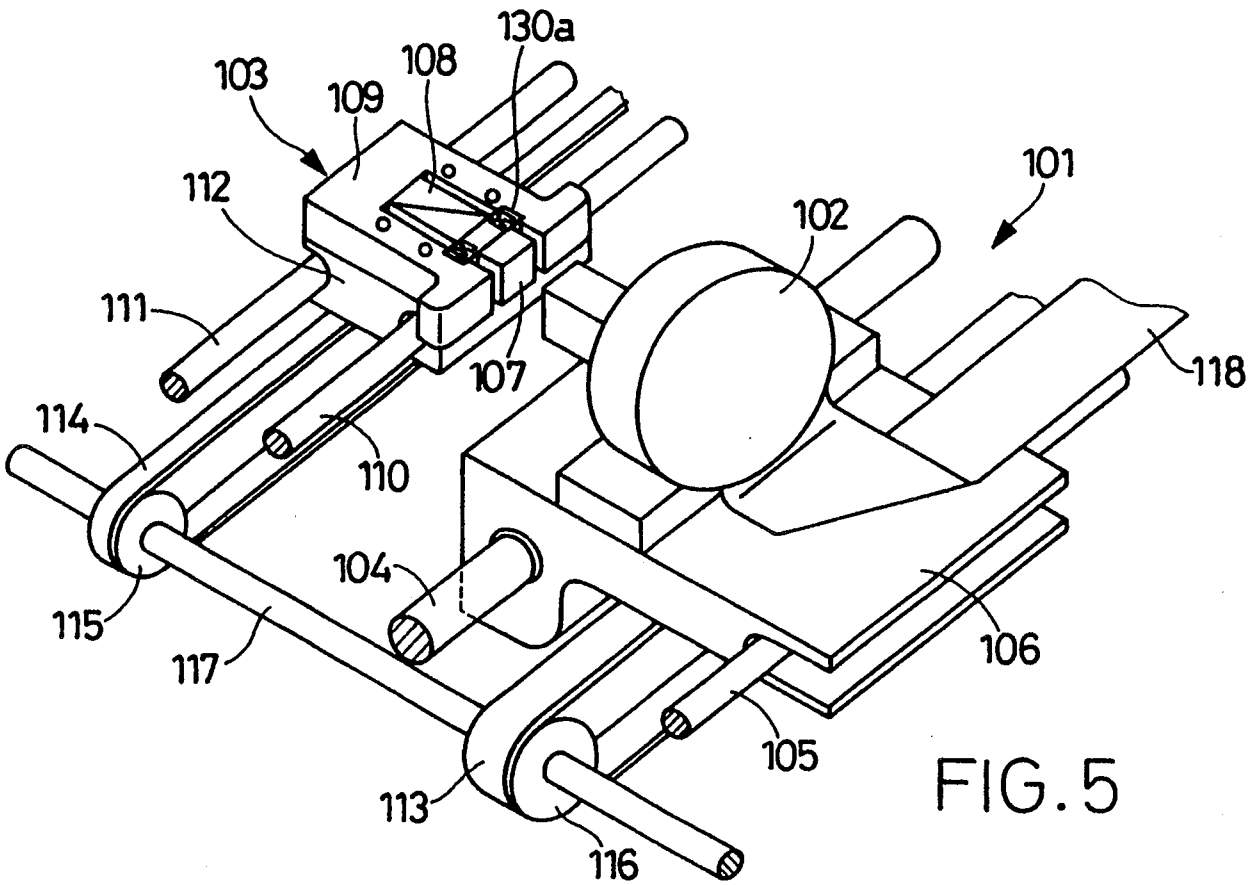
FIG. 5 is a perspective view of a part of a serial dot printer as another embodiment of the present invention.
Figure 6:
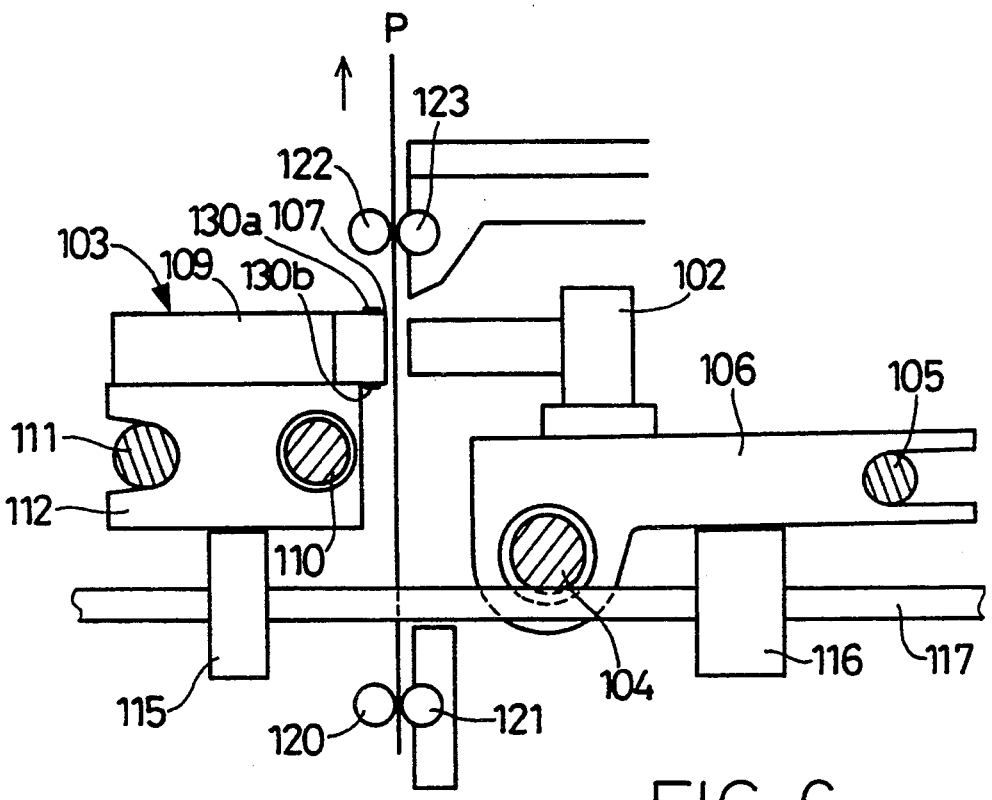
FIG. 6 is a cross-sectional view of the printer of FIG. 5.

Referring next to FIGS. 5 and 6, there is shown another embodiment of the present invention. FIG. 5 shows a serial dot printer 101 embodying the invention. The printer 101 includes a recording head 102 and a platen device 103. The recording head 102 is disposed such that the head 102 is opposed to a recording surface of a recording medium, P, set at a predetermined position. The platen device 103 is disposed such that the platen device 103 is opposed to the recording head 102, more specifically, a non-recording surface of the recording medium P. The recording head 102 is mounted on a first carriage 106. The first carriage 106 is supported on a first pair of guide shafts 104, 105, such that the recording head 102 is reciprocatable on, and along, the guide shafts 104, 106.

The platen device 103 includes a frame member 109. The frame member 109 is mounted on a second carriage 112 which is supported on a second pair of guide shafts 110, 111. The platen device 103 is reciprocatable on, and along, the second guide shafts 110, 111. The platen device 103 further includes a platen member 125 having a platen surface 107 which is to contact the non-recording surface of the recording medium P. The platen device 103 further includes a piezoelectric element 108. As shown in FIG. 7, the piezoelectric element 108 is at one of opposite ends thereof supported by the frame member 109 and is at the other end thereof connected to the platen member 125. A pair of flat springs 130*a*, 130*b* are fixed to the platen member 125 and the frame member 109 such that each flat spring 130*a*, 130*b* bridges the two members 125, 109.

The first carriage 106 supporting the recording head 102 is fixed to a first timing (toothed) belt 113 which is engaged with, and stretched between, a first drive pulley 115 and a follower or idle pulley (not shown) disposed spaced apart from the first drive pulley 115. Similarly, the second carriage 112 supporting the platen device 103 is fixed to a second timing (toothed) belt 114 which is engaged with, and stretched between, a second drive pulley 116 and a follower or idle pulley (not shown) disposed spaced apart from the second drive pulley 116. The first and second drive pulleys 115, 116 have an equal outer diameter, and are fixed to a common drive shaft 117 which extends in a direction perpendicular to the direction of extension of the guide shafts 104, 105, 110, 111. The drive shaft 117 is connected to a drive motor (not shown) via a drive mechanism (not shown), so that each drive pulley 115, 116 is rotated when the drive shaft 117 is rotated by the drive motor.

In the present embodiment, the recording head 102 includes a plurality of dot recording units which are radially arranged. Each recording unit is comprised of a dot recording wire for recording a dot on the recording medium P, a piezoelectric element for pressing an operative end of the recording wire against the medium P, and a motion-transmitting mechanism for amplifying the expanding and contracting mechanical distortion of the piezoelectric element and transmitting the amplified distortion to the recording wire. Each recording wire applies an impact force against the recording medium P via a printing ribbon such as an ink ribbon, according to a batch of recording data representing a character or other image pattern to be recorded. The recording data is supplied from a control device (not shown) to the recording head 102 via a flexible circuit 118.

Next, there will be described the operation of the printer 101. As shown in FIG. 6, a recording medium P is fed between the recording head 102 and the platen device 103, in a feeding direction indicated at arrow in the figure, by being nipped by, and between, a first pair of pinch rollers 120, 121 disposed on an upstream side as viewed in the feeding direction and subsequently a second pair of pinch rollers 122, 123 disposed on a downstream side of the feeding direction. Thus, the recording medium P is set at a predetermined position where the recording wires of the recording head 102 effect recording according to the recording data supplied thereto, by impacting against the recording medium P via the printing ribbon positioned therebetween.

When the recording head 102 is impacting against the recording medium P, an ultrasonic alternating electric voltage is applied to the piezoelectric element 108, so that the element 108 expands and contracts in a direction perpendicular to an operative surface of the recording head 102, and thereby vibrates the platen surface 107 of the platen member 125. As the recording head 102 is displaced along the recording surface of the recording medium P, the platen device 103 or piezoelectric element 108 is displaced along the non-recording surface of the medium P in the same direction as the direction of displacement of the recording head 102, in synchronism with the displacement of the head 102. After the recording of one character line has thus been completed on the recording medium P, the medium P is fed forward by the second pinch rollers 122, 123 disposed on the downstream side of the feeding direction.

Upon application of an ultrasonic alternating electric current to the piezoelectric element 108, the piezoelectric element 108 vibrates at an ultrasonic frequency, and the ultrasonic vibration of the element 108 is transmitted to the platen member 125. Thus, the platen surface 107 vibrates at the ultrasonic frequency. In the present embodiment, if a time duration in which the recording wires of the recording head 102 directly apply impact to the platen surface 107 for recording a dot on the recording medium P is about 40 to 50 μsec, a single cycle of expansion and contraction of the piezoelectric element 108 is completed in 10 μsec, so that at least two cycles of vibration of the element 108 occurs during the above indicated time duration for the one-dot recording operation. A control device (not shown) is pre-programmed to operate the recording head 102 and the piezoelectric element 108 in this manner.

Figure 8:
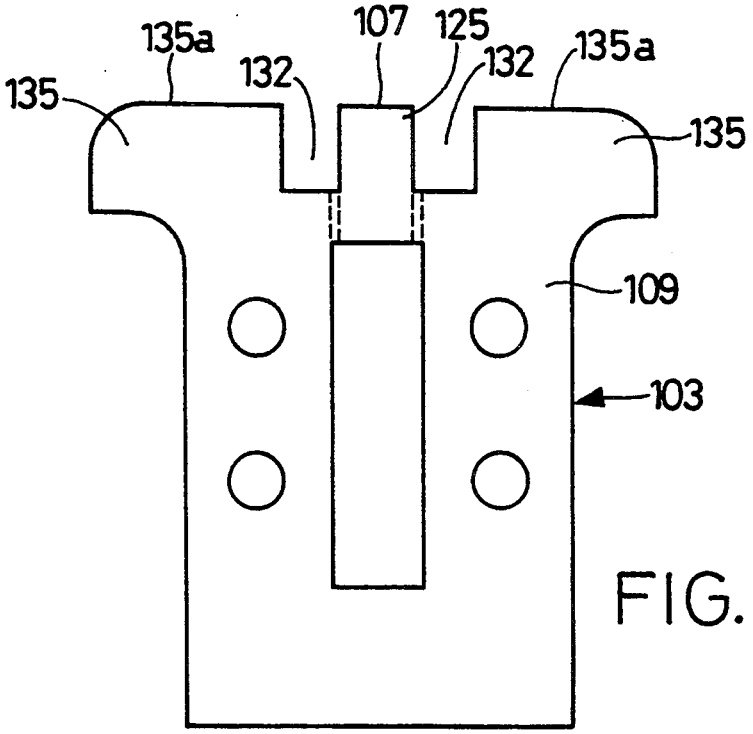
FIG. 8 is a view of the platen device of FIGS. 7A and 7B before flat springs 130*a*, 130*b* are fixed to a frame member 109 of the platen device.
Figure 9:
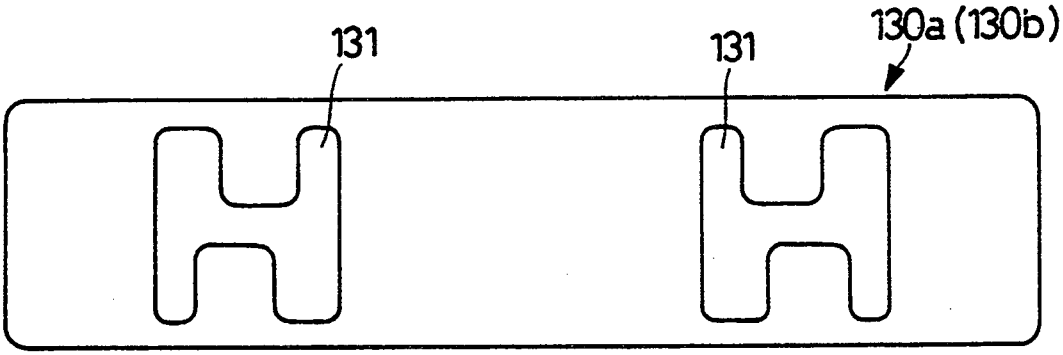
FIG. 9 is a plan view of the flat spring 130*a* or 130*b*.

Referring next to FIGS. 7 (7A and 7B), 8, and 9, there will be described the mechanism for preventing the platen member 125 and therefore the piezoelectric element 108 from vibrating in directions different from the direction perpendicular to the operative surface of the recording head 102. FIG. 7 shows the platen device 103 including the platen member 125 having the platen surface 107, the piezoelectric element 108 for vibrating the platen surface 107 in the direction of stacking of piezoelectric ceramic layers thereof, the frame member 109 for supporting the element 108, and the flat springs 130*a*, 130*b* for preventing the element 108 from vibrating in directions different from the direction of stacking of the ceramic layers (i.e., layer-stack direction) of the element 108. FIG. 8 shows the platen device 103 in which the platen member 125 is integral with the frame member 109 before the former 125 is separated from the latter 109. FIG. 9 shows in detail the flat spring 130*a* (identical with the spring 130*b*).

Figure 7A:
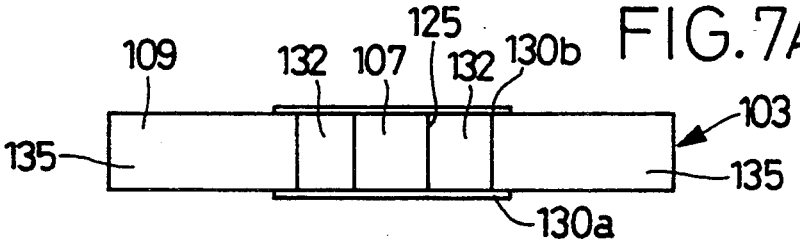
FIGS. 7A and 7B are a front and a plan view of a platen device employed in the printer of FIG. 5.
Figure 7B:
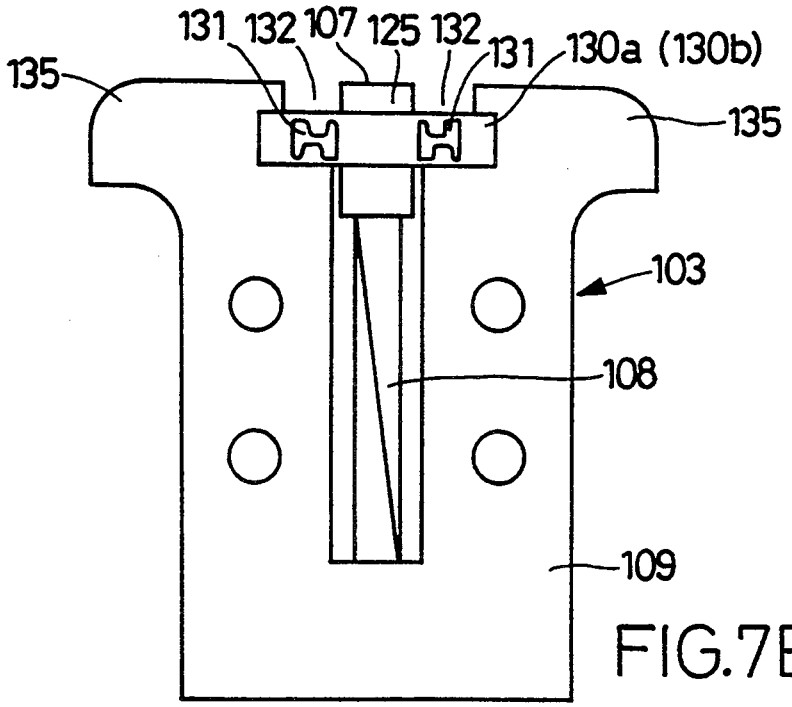

As shown in FIG. 7A and 7B, the flat springs 130*a*, 130*b* are fixed to opposite surfaces of the platen member 125 and opposite surfaces of the frame member 109, respectively. That is, each flat spring 130*a*, 130*b* bridges between the platen member 125 and the frame member 109. As shown in FIG. 8, the platen member 125 is initially formed integrally with the frame member 109, and then the former 125 is separated from the latter 109. The top surface of the platen member 125 as shown in FIG. 8 provides the platen surface 107. The frame member 109 includes a pair of shoulder portions 135, 135 which are located on both sides of the platen member 125 and have respective surfaces 135*a*, 135*a* each flush with the platen surface 107. The surfaces 135*a*, 135*a* of the shoulder portions 135, 135 serve for guiding the recording medium P. The frame member 109 has a recess 132 between the platen member 125 and each of the shoulder portions 135.

As shown in FIG. 9, each flat spring 130*a*, 130*b* is obtained by punching predetermined portions of a metal strip and thereby forming a pair of H-shaped openings 131, 131 through the thickness of the metal strip. Therefore, the flat spring 130*a*, 130*b* provides a four-point link mechanism around each H-shaped opening. The flat spring 130*a*, 130*b* permits the platen member 125 to vibrate only in the direction of expansion and contraction of the piezoelectric element 108. The use of a four-point link mechanism having a structure like the structure of the flat spring 130*a*, 130*b* is disclosed in Japanese Patent Application laid open under Publication No. 1(1989)-195060.

Each flat spring 130*a*, 130*b* is fixed by brazing to the platen member 125 and the two shoulder portions 135, 135. Subsequently, bridging portions (indicated at broken lines in FIG. 8) between the platen member 125 and the respective shoulder portions 135, 135 are cut off, so that the platen member 125 is separated from the frame member 109. In this condition, the platen member 125 is permitted to move only in the direction perpendicular to the operative surface of the recording head 102.

Upon application of an electric voltage to the piezoelectric element 108, the element 108 vibrates so as to press the platen member 125 against the recording medium P. In this situation, the four-point link mechanisms 131, 131 of the flat springs 130*a*, 130*b* each bridging the platen member 125 and the frame member 109, cooperate with each other to allow the platen member 125 to move only in the direction perpendicular to the operative surface of the recording head 102. Upon discharge of the electric charge of the piezoelectric element 108, the platen member 125 is retracted to its retracted or initial position. Even if the respective recording wires of the recording head 102 do not uniformly impact, i.e., partially impact, against the platen surface 107, the platen member 125 is not caused to move in a direction different from the direction perpendicular to the operative surface of the recording head 102. Thus, the flat springs 130*a*, 130*b* prevent the piezoelectric element 108 from being subjected to flexural or bending vibration applied thereto in a direction perpendicular to the layer-stack direction thereof.

Figure 12A:
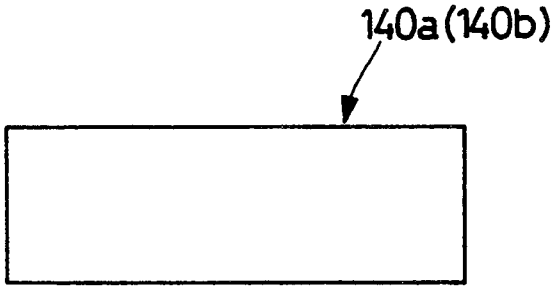
FIGS. 12A, 12B, and 12C are a plan, a front, and a side view of the $\pi$-shaped spring 140*a* or 140*b*.
Figure 12B:
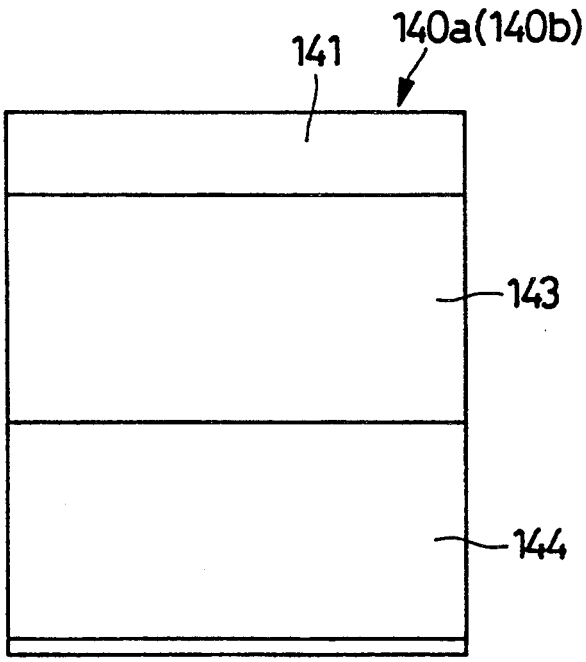
Figure 12C:
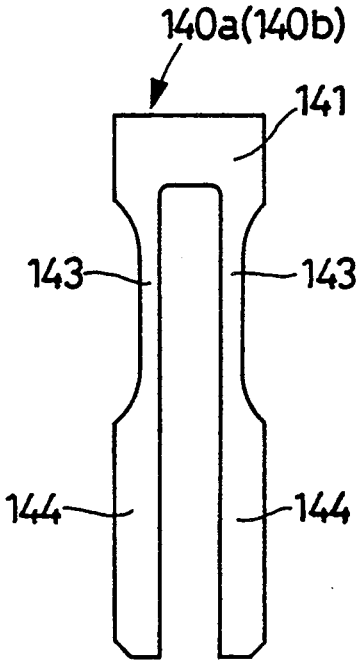
Figure 10A:
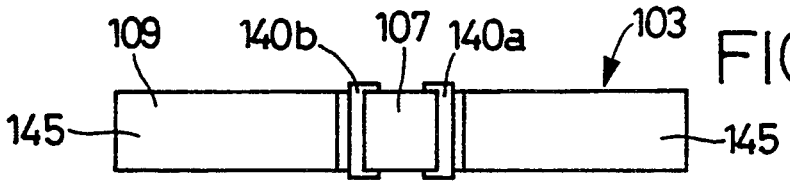
FIGS. 10A and 10B are a front and a plan view of a different platen device employed in the printer of FIG. 5.
Figure 10B:
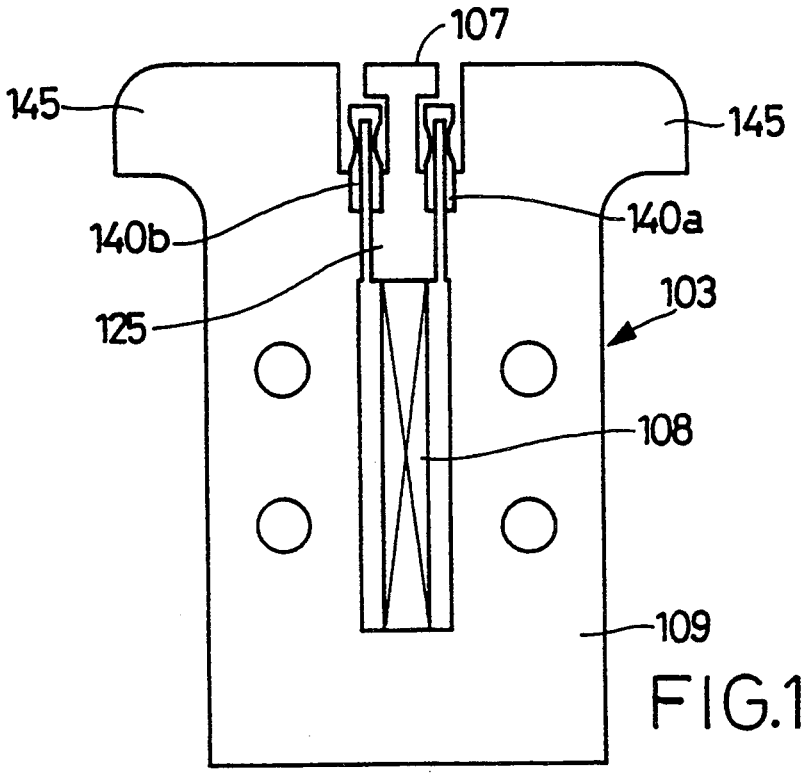
Figure 11:
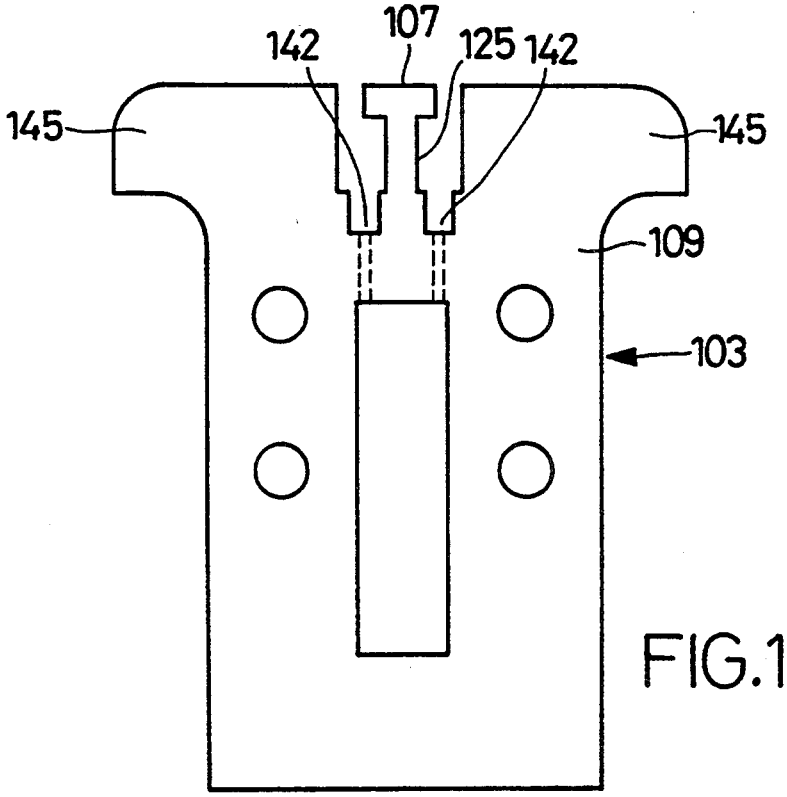
FIG. 11 is a view of the platen device of FIGS. 10A and 10B before $\pi$-shaped springs 140*a*, 140*b* are fixed to a frame member 109 of the platen device.

FIGS. 10A, 10B, 11, 12A, 12B, and 12C show a different platen device which is employable in the printer 101. In this platen device, a pair of $\pi$-shaped springs 140*a*, 140*b* are used in place of the flat springs 130*a*, 130*b* shown in FIG. 9. However, the $\pi$-shaped springs 140*a*, 140*b* have the same function as that of the flat springs 130*a*, 130*b*, that is, allow the piezoelectric element 108 or platen member 125 to move only in the direction perpendicular to the operative surface of the recording head 102. FIGS. 10A and 10B show the platen device 103 which includes a platen member 125 having a platen surface 107, a piezoelectric element 108 for vibrating the platen surface 107 in the stack-layer direction thereof, a frame member 109 for supporting the element 108, and the $\pi$-shaped springs 140*a*, 140*b* for allowing the element 108 to vibrate only in the layer-stack direction thereof. FIG. 11 shows the platen device 103 in which the platen member 125 is integral with the frame member 109 before the former 125 is separated from the latter 109. FIGS. 12A, 12B and 12C show in detail the $\pi$-shaped spring 140*a* (identical with the spring 140*b*).

As shown in FIG. 10A and 10B, the $\pi$-shaped springs 140*a*, 140*b* are provided between a pair of shoulder portions 145, 145 of the frame member 109 and the platen member 125 having the platen surface 107. That is, each of the $\pi$-shaped springs 140*a*, 140*b* bridges between the platen member 125 and a corresponding one of the shoulder portions 145, 145 of the frame member 109. Upon application of an electric voltage to the piezoelectric element 108, the $\pi$-shaped springs 140*a*, 140*b* cooperate with each other to allow the element 108 to expand and contract only in the direction perpendicular to the operative surface of the recording head 102.

There will be described the steps carried out for assembling the $\pi$-shaped springs 140*a*, 140*b* with the frame member 109. As shown in FIG. 11, the platen member 125 is initially formed integrally with the frame member 109, and then the former 125 is separated from the latter 109. The frame member 109 has a recess 142 between the platen member 125 and each of the shoulder portions 145.

As shown in FIGS. 12A, 12B, and 12C, each of the $\pi$-shaped springs 140*a*, 140*b* has a generally $\pi$-shaped cross section, and includes a head portion 141, a pair of leg portions 144, 144, and a pair of flexible intermediate portions 143, 143 respectively connecting the leg portions 144, 144 to opposite ends of the head portion 141. Each $\pi$-shaped spring 140*a*, 140*b* is obtained by bending a metal plate at respective locations corresponding to the opposite ends of the head portion 141 from which the intermediate flexible portions 143, 143 respectively extend. The leg portions 144, 144 of each $\pi$-shaped spring 140*a*, 140*b* is press-fitted in a corresponding one of the recesses 142, 142 of the frame member 109, and subsequently bridging portions (indicated at broken lines in FIG. 11) between the platen member 125 and the respective shoulder portions 145, 145 are cut off, so that the platen member 125 is separated from the frame member 109. In this condition, the platen member 125 is allowed to move only in the direction perpendicular to the operative surface of the recording head 102.

The two $\pi$-shaped springs 140*a*, 140*b* exert an equal biasing force to the piezoelectric element 108, in opposite directions parallel the platen surface 107, so that the platen member 125 is held with stability between the shoulder portions 145, 145 of the frame member 109. If some external force is applied to the platen member 125 in the directions in which the springs 140*a*, 140*b* exert the respective biasing forces to the platen member 125, the platen member 125 is not moved so largely, if any, in those directions. Like the flat springs 130*a*, 130*b* shown in FIG. 9, the $\pi$-shaped springs 140*a*, 140*b* cooperate with each other to allow the platen member 125 to vibrate only in the direction perpendicular to the operative surface of the recording head 102, and therefore produce the same advantages as those with the flat springs 130*a*, 130*b*. The $\pi$-shaped springs 140*a*, 140*b* do not obstruct the motion of the platen member 125 in the direction of vibration of the piezoelectric element 108.

As is apparent from the foregoing description, the flat springs 130*a*, 130*b* or $\pi$-shaped springs 140*a*, 140*b* fixed to the platen member 125 to which the piezoelectric element 108 is connected, serve for preventing the platen member 125 from vibrating in directions different from the direction of vibration of the piezoelectric element 108. Even if the recording wires of the recording head 102 ununiformly or partially apply impact forces to the platen surface 107, the platen member 125 is caused to move only in the direction perpendicular to the operative surface of the recording head 102.

Thus, the piezoelectric element 108 connected to the platen member 125 repetitively expands and contracts with high stability, and therefore the element 108 effectively is prevented from being subjected to bending vibration applied thereto in the direction perpendicular to the layer-stack direction thereof. In the event that the frequency of the alternating current applied to the element 108 coincides with the frequency of the bending vibration of the element 108 resulting from some component of the impact force partially applied to the element 108 by the recording wires of the recording head 102, and therefore the former vibration resonates with the latter vibration, a large bending vibration will occur in the element 108. Even in this case, however, the flat springs 130*a*, 130*b* or $\pi$-shaped springs 140*a*, 140*b* employed in the printer 101 effectively prevents the adverse bending vibration from occurring to the piezoelectric element 108.

While, in the printer 101, the flat springs 130*a*, 130*b* or $\pi$-shaped springs 140*a*, 140*b* are used alone, it is possible to use those springs 130*a*, 130*b* and 140*a*, 140*b* in combination.

Figure 13:
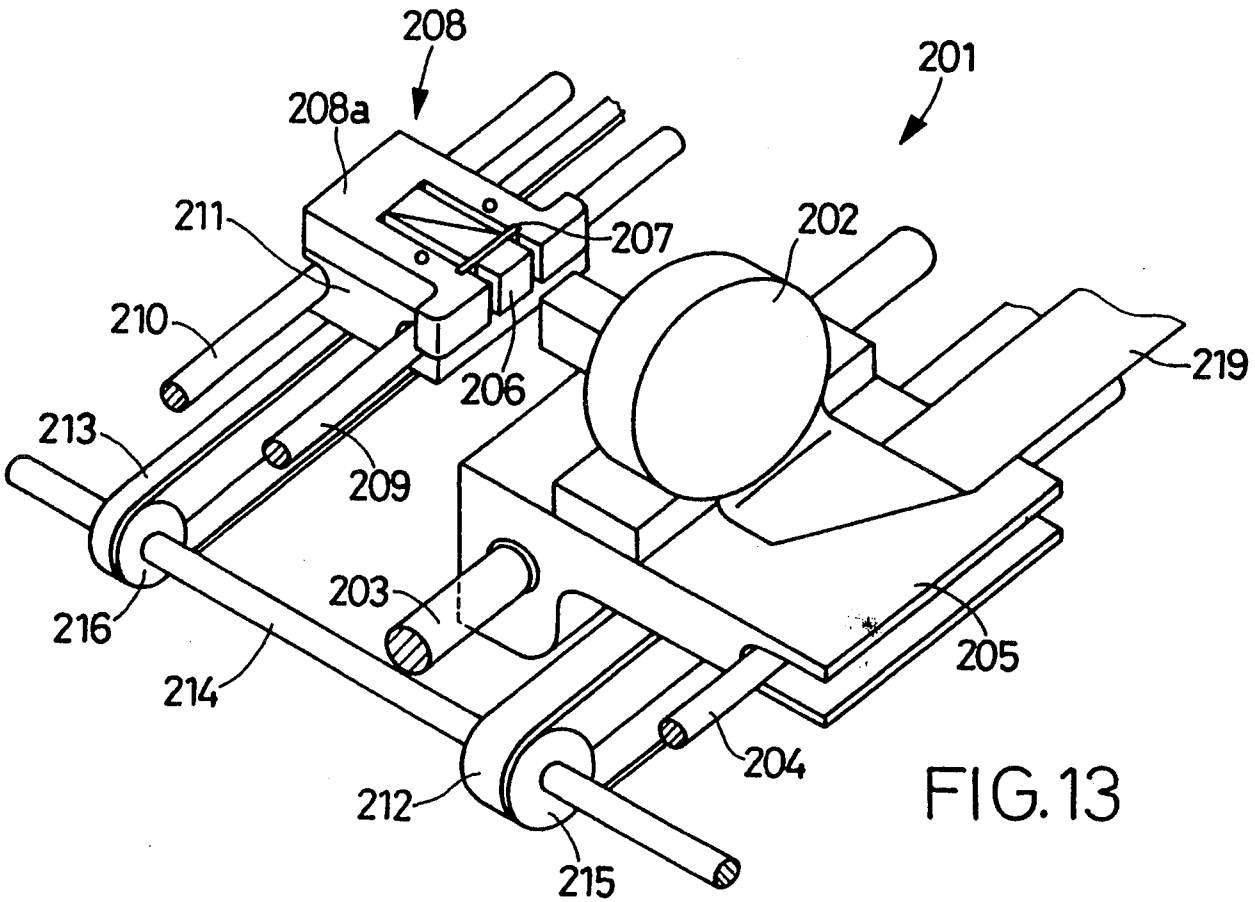
FIG. 13 is a perspective view of a part of a serial dot printer as yet another embodiment of the present invention.
Figure 14:
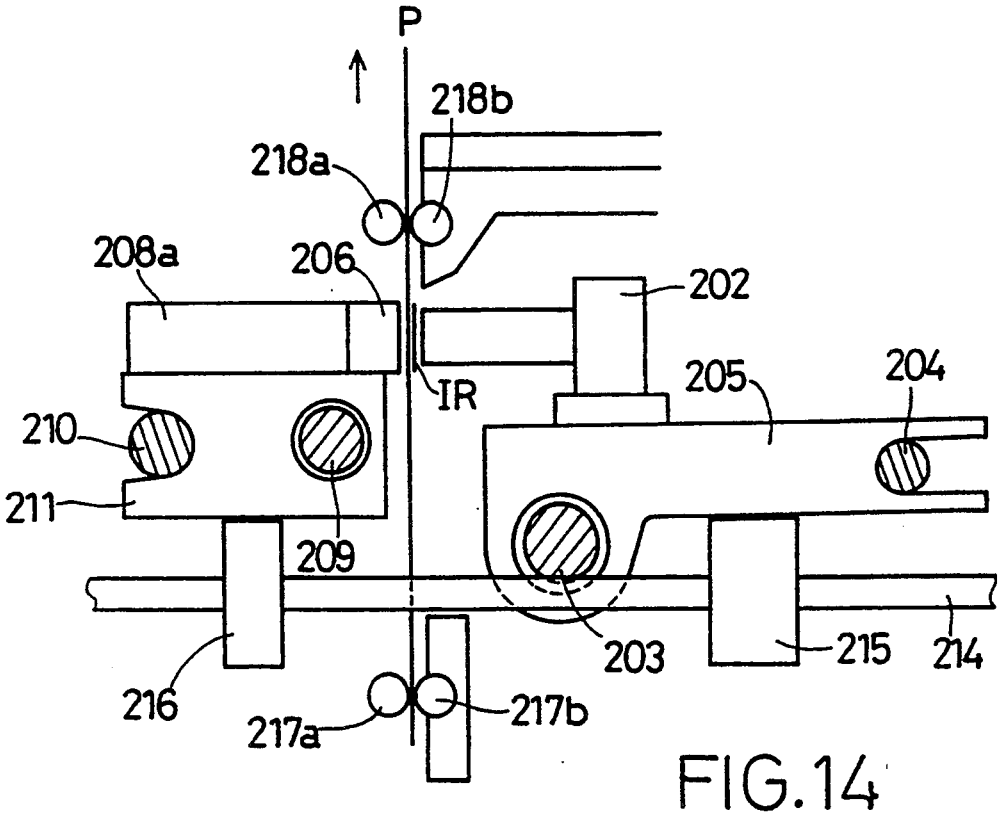
FIG. 14 is a cross-sectional view of the printer of FIG. 13.

Referring further to FIGS. 13 and 14, there is shown yet another embodiment of the present invention. In FIG. 13, a serial dot printer 201 embodying the invention is shown with respect to a part thereof including a recording head 202 and a platen device 208. The recording head 202 is mounted on a first carriage 205. The first carriage 205 is supported on a first main guide shaft 203 and a first secondary guide shaft 204, such that the recording head 202 is reciprocatable on, and along, the guide shafts 203, 204. The platen device 208 includes a platen member 206, and a frame member 208*a* supporting the platen member 206 via a flat spring 207. The platen device 208 is mounted on a second carriage 211 which is supported on a second main guide shaft 209 and a second secondary guide shaft 210, such that the platen device 208 is reciprocatable on, and along, the guide shafts 209, 210. The recording head 202 is disposed such that the head 202 is opposed to a recording surface of a recording medium, P, set at a predetermined position. The platen device 208 is disposed such that the platen member 206 is opposed to the recording head 202, more specifically, a non-recording surface of the recording medium P. The four guide shafts 203, 204, 209, 210 extend parallel to each other.

The first carriage 205 supporting the recording head 202 is fixed to a first timing (toothed) belt 212 which is engaged with, and stretched between, a first drive pulley 215 and a follower pulley (not shown) disposed spaced apart from the first drive pulley 215. Similarly, the second carriage 211 supporting the platen device 208 is fixed to a second timing (toothed) belt 213 which is engaged with, and stretched between, a second drive pulley 216 and a follower pulley (not shown) disposed spaced apart from the second drive pulley 216. The first and second carriages 205, 211 are fixed to the first and second timing belts 212, 213, such that those carriages 205, 211 are opposed to each other. The first and second drive pulleys 215, 216 have an equal outer diameter, and are fixed to a common drive shaft 214 which extends in a direction perpendicular to the direction of extension of the guide shafts 203, 204, 209, 210. The drive shaft 214 is connected to a drive motor (not shown) via a drive mechanism (not shown), so that each drive pulley 215, 216 is rotated when the drive shaft 214 is rotated by the drive motor. Thus, the recording head 202 and the platen device 208 are displaceable in the same and one direction in such a manner that those members 202, 208 continue to be opposed to each other.

As shown in FIG. 14, a recording medium P is fed between the recording head 202 and the platen device 208, in a feeding direction indicated at arrow in the figure, by being nipped by, and between, a first pair of pinch rollers 217*a*, 217*b* disposed on an upstream side as viewed in the feeding direction and subsequently a second pair of pinch rollers 218*a*, 218*b* disposed on a downstream side of the feeding direction.

A flexible circuit 219 is connected to the recording head 202. Recording data is supplied from a control device (not shown) to the recording head 202 via the flexible circuit 219. The recording head 202 includes a plurality of dot recording units which are radially arranged. Each recording unit is comprised of a dot recording wire for recording a dot on the recording medium P, a piezoelectric element for pressing an operative end of the wire against the medium P, and a motion-transmitting mechanism for amplifying the expanding and contracting mechanical distortion of the piezoelectric element and transmitting the amplified distortion to the wire.

Figure 15:
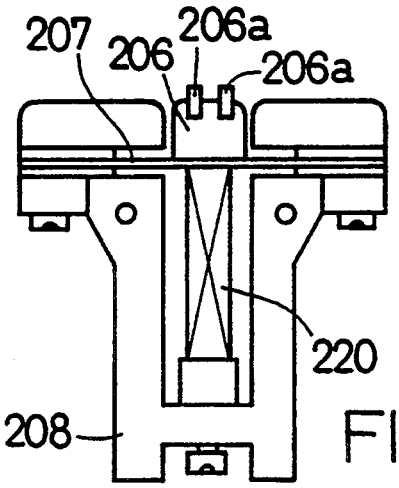
FIG. 15 is a plan view of a platen device employed in the printer of FIG. 13.

FIG. 15 illustrates the platen device 208 in detail. A stacked piezoelectric element 220 is connected to one of opposite surfaces of the flat spring 207, to the other surface of which the platen member 206 is fixed. The piezoelectric element 220 is supported at the other end thereof by the frame member 208*a*. When an alternating electric voltage which alternates at a frequency ranging from several thousand herz (Hz) to ultrasonic range is applied to the piezoelectric element 220, the element 220 repetitively expands and contracts, i.e., vibrates in a direction perpendicular to an operative surface of the recording head 202.

One or more protruding portions 206*a* are provided on a platen surface of the platen member 206. Each protruding portion 206*a* has a width substantially equal to a diameter of the operative end of each recording wire of the recording head 202. The protruding portion or portions 206*a* is/are arranged so as to be aligned with the operative ends of the recording wires of the recording head 202. The protruding portion or portions 206*a* is/are preferably formed of a durable material such as cemented carbide, tungsten, and ceramic zirconia. One or more protruding members 206*a* is/are formed separately from the platen member 206, and partially embedded in one or more grooves formed in the platen surface of the platen member 206 which is preferably formed of stainless steel.

Hereunder, there will be described the operation of the printer 201 constructed as described above. A recording medium P is fed to a predetermined position between the recording head 202 and the platen member 206, by nipped by the first pair of pinch rollers 217*a*, 217*b* located on the upstream side of the feeding direction. Appropriate ones of the recording wires of the recording head 202 apply impact forces to the recording medium P set in position via a printing ribbon, IR, such as an ink ribbon, so as to record a character or other image pattern on the medium P. In the event that is used a multiple-sheet recording medium P consisting of a set of superposed sheets including a non-copying top sheet and some carbon-copying sheets under the top sheet, an ink copy is produced on the top sheet and a carbon copy is produced on each carbon-copying sheet because of the impact force applied to the medium P by the recording head 202.

When the impact force of the recording head 202 is being exerted to the recording medium P, an alternating electric voltage is applied to the piezoelectric element 220, so that the element 20 repetitively expands and contrasts in a direction perpendicular to the operative surface of the recording head 202, and thereby applies vibration to the platen member 206 via the flat spring 207. The frequency of vibration of the platen member 206 is selected such that one to several cycles of vibration (i.e., expansion and contraction) of the platen member 206 occur during a time duration in which the recording wires of the recording head 202 directly contact with the recording medium P.

In synchronism with times of feeding of respective batches of recording data to the recording head 202 from a host computer (not shown), the drive shaft 214 is rotated by a drive motor (not shown), so that the drive pulleys 215, 216 are rotated. Consequently, the first carriage 205 supporting the recording head 202 is displaced with the first timing belt 212 along a recording surface of the recording medium P. Since the second carriage 211 supporting the platen member 206 is also connected to the drive shaft 214, the platen member 206 concurrently is displaced with the second timing belt 213 along a non-recording surface of the medium P in the same direction as the direction of displacement of the recording head 202, such that the platen surface of the platen member 206 continues to be opposed to the operative surface of the recording head 202. Since the outer diameters of the first and second drive pulleys 215, 236 are equal to each other, the rate or speed of the displacement of the platen member 206 is equal to that of the displacement of the recording head 202. As the recording head 202 is displaced along the recording surface of the recording medium P, the platen member 206 is, while being vibrated by the piezoelectric element 220, displaced along the non-recording surface of the medium P in the same direction as the direction of displacement of the recording head 202, in synchronism with the displacement of the head 202. After the recording of one character line has thus been completed on the recording medium P, the medium P is fed forward by a predetermined incremental length by the second pair of pinch rollers 218*a*, 218*b* disposed on the downstream side of the feeding direction.

When the recording wires of the recording head 202 are impacting against the recording surface of the recording medium P for recording dots as information on the medium P, the protruding portions 206*a* of the platen member 206 react to the non-recording surface of the medium P, in response to the impact forces of the recording wires of the head 202. In addition, the vibration of the platen member 306 is applied to the medium P. Thus, a clear image is produced on each of the superposed sheets of the recording medium P down to the bottom sheet thereof. In addition, since a low impact force of the recording head 202 is enough to produce a clear copy on every coping sheet of the multiple-sheet recording medium P, the printer 201 is operable by generating only reduced noise resulting from repetitive impacts of the recording head 202 with the platen member 206.

Figure 16:
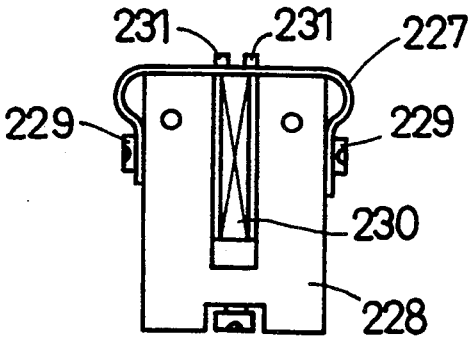
FIG. 16 is a plan view of a different platen device employed in the printer of FIG. 13.

FIG. 16 shows a different platen device which is employable in the printer 201. This platen device include, in addition to a frame member 228*a*, a flat spring 227 secured on a front surface of the frame member 228*a*. The flat spring 227 has opposite end portions which are bent and fixed to opposite side surfaces of the frame member 228 with the help of screws 229, 229. One of opposite surfaces of the flat spring 227 serves as a platen surface to which one or more protruding members 231 are fixed. A piezoelectric element 230 is connected to the other surface of the flat spring 227. This platen device does not need an exclusive platen member like the platen member 206 shown in FIG. 15, since an intermediate portion of the flat spring 227 provides the platen surface opposed to the recording head 202. In this platen device, the vibration of the piezoelectric element 230 is transmitted to a non-recording surface of a recording medium P via only the flat spring 227 and the protruding members 231. This arrangement is advantageous in that the platen surface of the flat spring 227 exhibits enhanced response to the vibration of the piezoelectric element 230 and therefore that dots as information are recorded or printed on the medium P with higher quality and reliability.

Figure 17A:
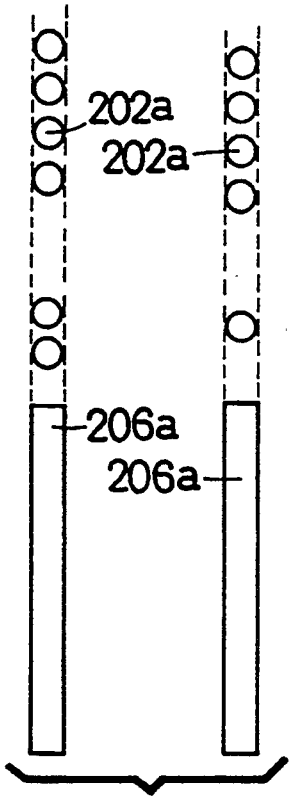
FIGS. 17A, 17B, 17C, and 17D are views of various arrangements of dot recording wires of a recording head of the printer of FIG. 13, and corresponding shapes of protruding portions of a platen surface of the printer.
Figure 17B:
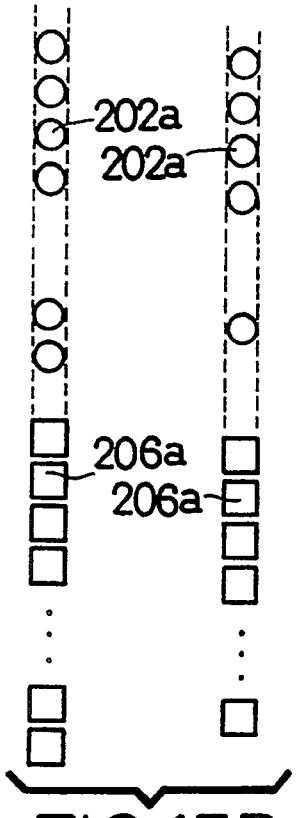
Figure 17C:
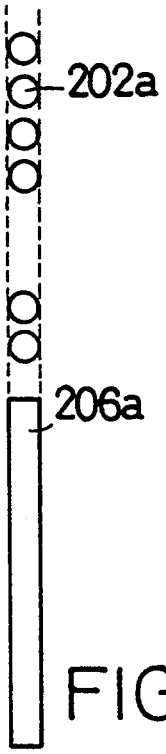
Figure 17D:
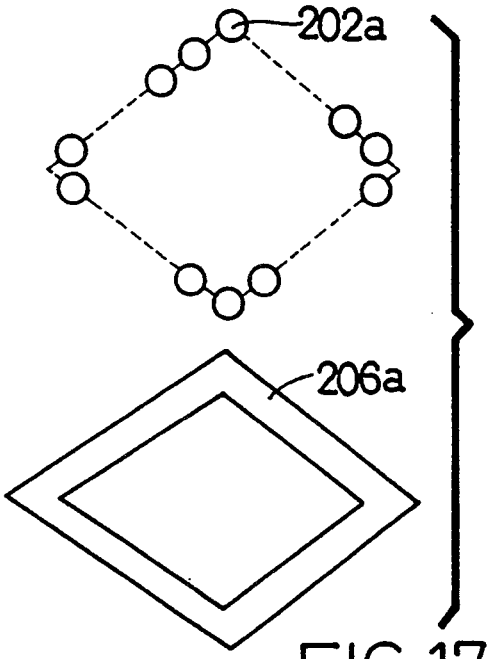

FIGS. 17A, 17B, 17C, and 17D shows various arrangements of the operative ends 202*a* of the recording wires of the recording head 202, and various arrangements of the protruding portion or portions 206*a* of the platen member 206. The upper half of each FIG. 17A, 17B, 17C, 17D shows an arrangement of the operative ends 202*a* of the recording wires, while the lower half of each FIG. 17A, 17B, 17C, 17D shows an arrangement of the protruding portion or portions 206*a*. FIG. 17A shows the arrangements of the operative ends 202*a* of the recording wires of the recording head 202 and the two protruding portions 206 employed in the printer 201 shown in FIG. 13. The operative ends 202*a* of the recording wires are arranged in two vertical arrays spaced apart from each other by a predetermined distance. In order to be able to be aligned with the two arrays of wire ends 202*a*, two vertical elongate protruding portions 206*a* are formed on the platen surface, like rails, at substantially the same spaced-part distance as that of the two arrays of wire ends 202*a*. FIG. 17B shows a multiplicity of identical rectangular members 206*a* serving as the protruding portions protruding from the platen surface. The rectangular members 206*a* correspond to the respective operative ends 202*a* of the recording wires arranged in two vertical arrays, and are arranged in two vertical arrays so as to be aligned with the wire ends 202*a*. FIGS. 17C and 17D show a single vertical elongate member 206*a* and a rhombic member 206*a* which serve as the protruding portion protruding from the platen surface and respectively correspond to a single vertical array and a rhombic array of the operative ends 202*a* of the recording wires of the recording head 202.

Figure 18A:
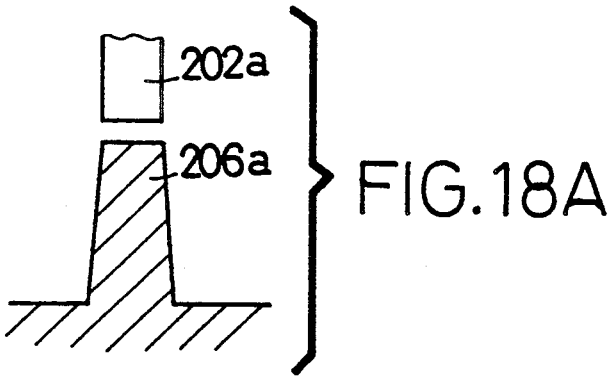
FIGS. 18A, 18B, 18C, and 18D are cross-sectional views of various protruding portions of the platen surface of the printer of FIG. 13.
Figure 18B:
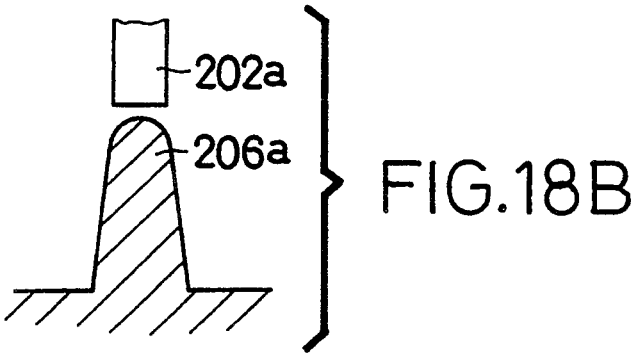
Figure 18C:
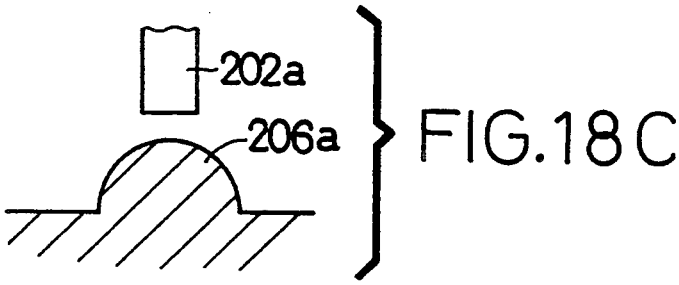
Figure 18D:
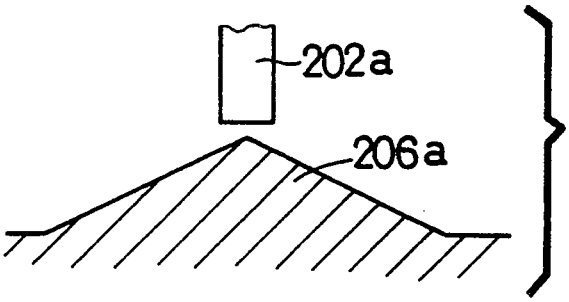

FIGS. 18A, 18B, 18C, and 18D show various cross-sectional shapes of the protruding portion 206*a* of the platen member 206. As shown in FIG. 18A, the two protruding portions 206*a* of the platen member 206 used in the printer 201 of FIG. 13 have a plane top surface which is opposed to the operative surface of the recording head 202. However, the protruding portion or portions 206*a* may have a curved top surface as shown in FIG. 18B, 18C, or 18D.

Figure 19:
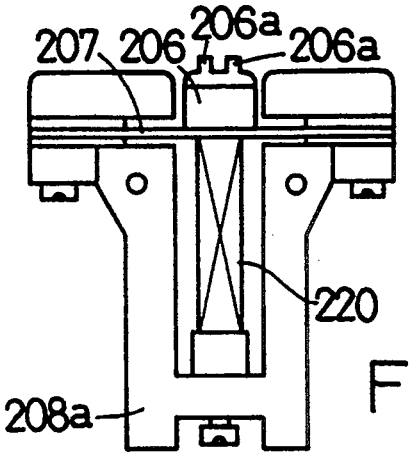
FIG. 19 is a plan view of a different platen device employed in the printer of FIG. 13.

Although the two protruding portions 206*a* of the platen member 206 of FIGS. 15 are partially embedded in the recesses (e.g., grooves or holes) formed in the platen surface, it is possible to adopt other manners of providing one or more protruding portions on the platen surface. For example, as shown in FIG. 19, a plate member including two elongate protruding portions is fixed to a platen surface of a platen member 206 which surface is opposed to the operative surface of the recording head 202.

Figure 20A:
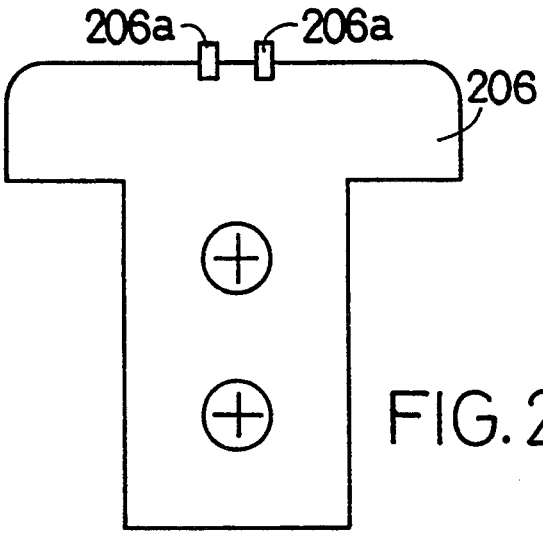
FIGS. 20A and 20B are views of different platen devices employed in the printer of FIG. 13.
Figure 20B:
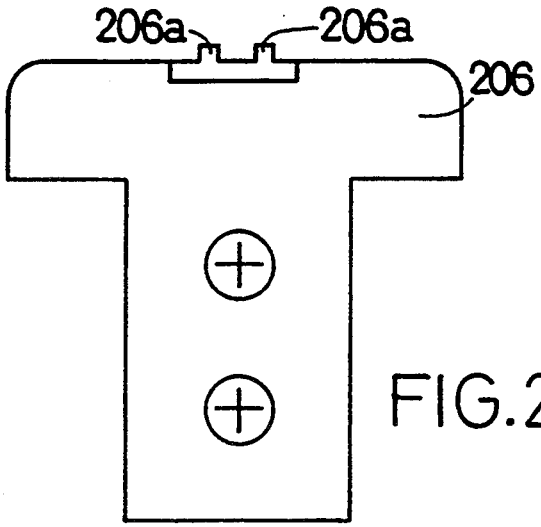

While the piezoelectric element 220 is used for vibrating the platen member 206 or flat spring 227 in the platen devices of FIGS. 15 and 16, the platen device may be otherwise embodied. For example, FIG. 20A shows two elongate members 206*a* are partially embedded in two elongate grooves formed in a platen surface of a frame member 206 which surface is opposed to the recording head 202. The elongate members 206 serve as the protruding portions protruding from the platen surface. FIG. 20B shows a plate member including two elongate protruding portions 206*a* which member is fixed to a platen surface of a frame member 206 which surface is opposed to the recording head 202. In the platen devices shown in FIGS. 20A and 20B, no piezoelectric element is used.

Figure 21:
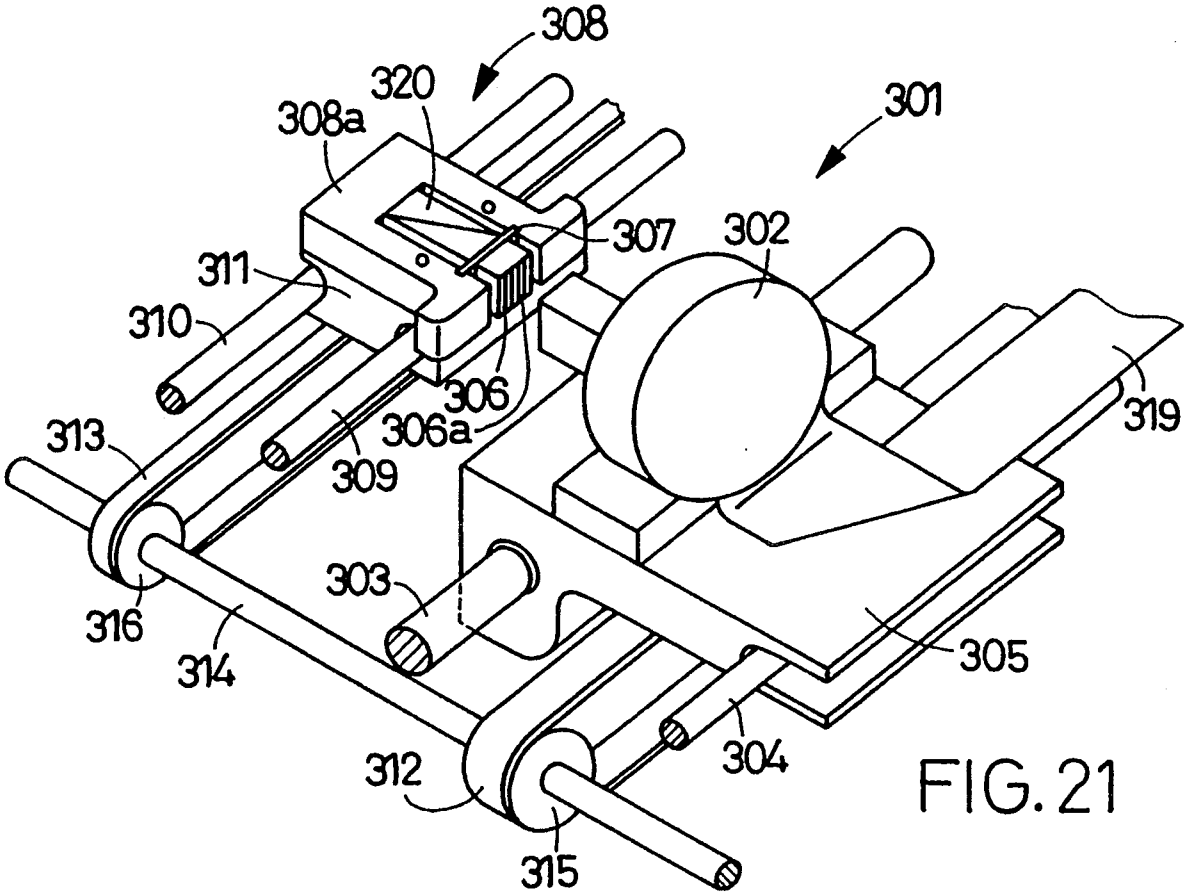
FIG. 21 is a perspective view of a part of a serial printer as a further embodiment of the present invention.
Figure 22:
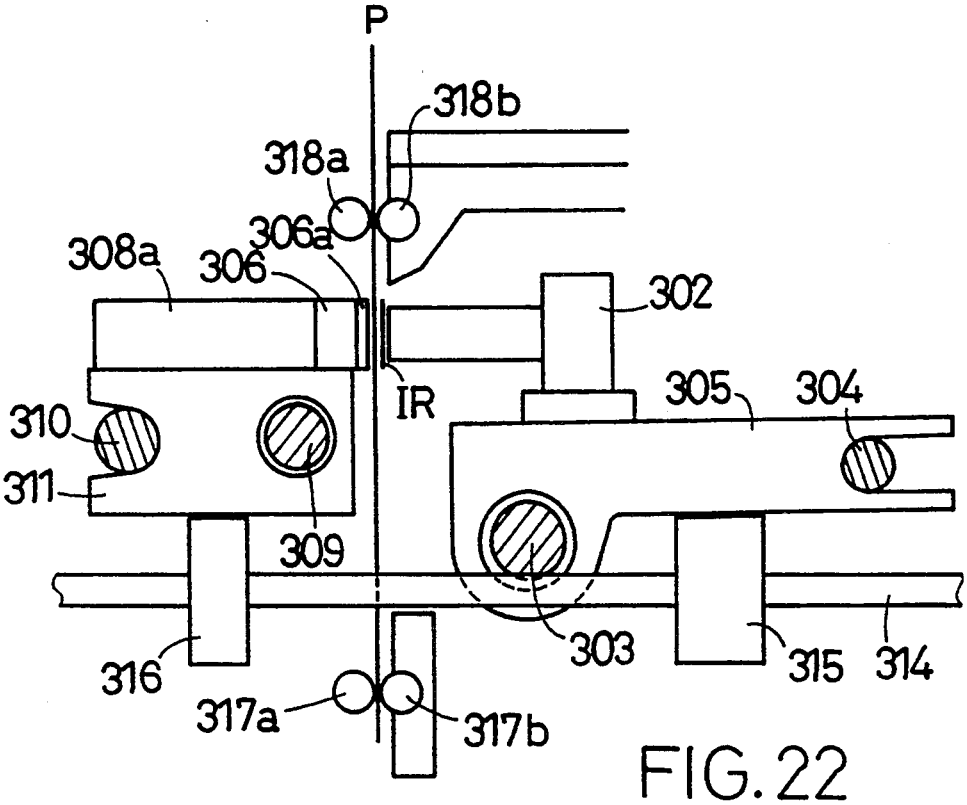
FIG. 22 is a cross-sectional view of the printer of FIG. 21.

Referring next to FIGS. 21 and 22, there is shown a further embodiment of the present invention. In FIG. 21, a serial dot printer 301 embodying the invention is shown with respect to a part thereof including a recording head 302 and a platen device 308. The recording head 302 is mounted on a first carriage 305. The first carriage 305 is supported on a first main guide shaft 303 and a first secondary guide shaft 304, such that the recording head 302 is reciprocatable on, and along, the guide shafts 303, 304. The first main guide shaft 303 is rotatable about an axis line slightly eccentric with a center line of the same 303, and extends through a hole formed through the first carriage 305. The platen device 308 includes a platen member 306 which is supported by a frame member 308*a* via a flat spring 307. The frame member 308*a* is mounted on a second carriage 311 which is supported on a second main guide shaft 309 and a second secondary guide shaft 310, such that the platen device 308 is reciprocatable on, and along, the guide shafts 309, 310. The recording head 302 is disposed such that the head 302 is opposed to a recording surface of a recording medium, P, set at a predetermined position. The platen device 308 is disposed such that the platen member 306 is opposed to the recording head 302, more specifically, a non-recording surface of the recording medium P. The four guide shafts 303, 304, 309, 310 extend parallel to each other. The platen member 306 includes one or more protruding portions 306*a* on a platen surface thereof which is opposed to an operative surface of the recording head 302.

The first carriage 305 supporting the recording head 302 is fixed to a first timing (toothed) belt 312 which is engaged with, and stretched between, a first drive pulley 315 and a follower pulley (not shown) disposed spaced apart from the first drive pulley 315. Similarly, the second carriage 311 supporting the platen device 308 is fixed to a second timing (toothed) belt 313 which is engaged with, and stretched between, a second drive pulley 316 and a follower pulley (not shown) disposed spaced apart from the second drive pulley 316. The first and second carriages 305, 311 are fixed to the first and second timing belts 312, 313, respectively, such that those carriages 305, 311 are opposed to each other. The first and second drive pulleys 315, 316 have an equal outer diameter, and are fixed to a common drive shaft 314 which extends in a direction perpendicular to the direction of extension of the guide shafts 303, 304, 309, 310. The drive shaft 314 is connected to a carriage drive motor 321 (FIG. 23) via a drive mechanism (not shown), so that each drive pulley 315, 316 is rotated when the drive shaft 314 is rotated by the drive motor 321. Thus, the recording head 302 and the platen member 306 are displaceable in the same and one direction in such a manner that those members 302, 306 continue to be opposed to each other.

As shown in FIG. 22, a recording medium P is fed between the recording head 302 and the platen member 306, in a feeding direction indicated at arrow in the figure, by being nipped by, and between, a first pair of pinch rollers 317*a*, 317*b* disposed on an upstream side as viewed in the feeding direction and subsequently a second pair of pinch rollers 318*a*, 318*b* disposed on a downstream side of the feeding direction.

A flexible circuit 319 is connected to the recording head 302. Recording data is supplied from a control device (not shown) to the recording head 302 via the flexible circuit 319. The recording head 302 includes a plurality of dot recording units which are radially arranged. Each recording unit is comprised of a dot recording wire for recording a dot on the recording medium P, a piezoelectric element for pressing an operative end of the wire against the medium P, and a motion-transmitting mechanism for amplifying the expanding and contracting mechanical distortion of the piezoelectric element and transmitting the amplified distortion to the wire.

The platen device 308 has the same construction as that of the platen device 208 shown in FIG. 15. The platen device 308 includes, in addition to the platen member 306, a stacked piezoelectric element 320 which is connected to one of opposite surfaces of the flat spring 307, to the other surface of which the platen member 306 is fixed. When an alternating electric voltage whose frequency falls in a range of from several thousand herz (Hz) to ultrasonic range is applied to the piezoelectric element 320, the element 320 repetitively expands and contracts, i.e., vibrates in a direction perpendicular to the operative surface of the recording head 302.

One or more protruding portions 306*a* are provided on a platen surface of the platen member 306 which is opposed to the operative surface of the recording head 302. Each protruding portion 306*a* has a width substantially equal to a diameter of the operative end of each recording wire of the recording head 302. The protruding portion or portions 306*a* is/are arranged so as to be aligned with the operative ends of the recording wires of the recording head 302. The protruding portion or portions 306*a* is/are preferably formed of a durable material such as cemented carbide, tungsten, and ceramic zirconia. One or more protruding members 306*a* are produced separately from the platen member 306, and partially embedded in one or more grooves formed in the platen surface of the platen member 306 which is preferably formed of stainless steel.

Figure 23:
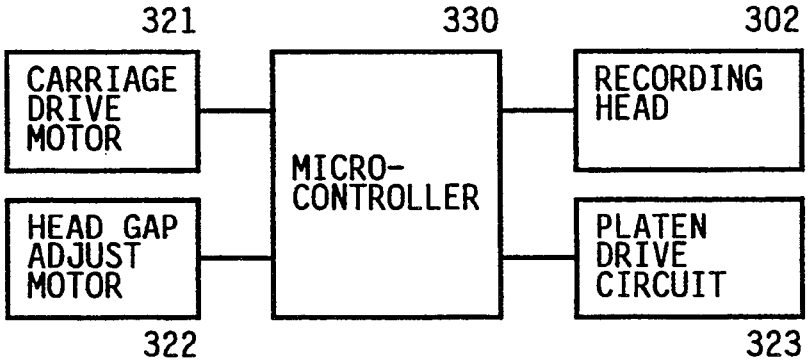
FIG. 23 is a block diagram of a control circuit of the printer of FIG. 21.

As shown in FIG. 23, the recording operation of the recording head 302 is controlled by a microcontroller 330. To the controller 330, are connected the carriage drive motor 321 and a head gap adjust motor 322 for rotating the first main guide shaft 303 about its eccentric axis line. The controller 330 drives the head gap adjust motor 322 for advancing the first carriage 305 or recording head 302 from an initial, reference position toward the platen member 306 until the operative surface of the recording head 302 presses the recording medium P against the platen surface of the platen member 306. During this operation, the controller 330 counts the number of pulses supplied to the adjust motor 322 necessary for advancing the carriage 305 from the reference position to a position where the recording head 302 presses the medium P on the platen surface and therefore the advancing of the head 302 is stopped. Thus, the controller 330 measures a thickness of the recording medium P. It can generally be estimated that, if the measured thickness of the medium P is great, the medium P would be such a multiple-sheet recording medium consisting of a set of superposed sheets including a non-copying top sheet and a great number of copying sheets under the top sheet, and also that the greater the thickness of the medium P is, the greater number of superposed sheets the medium P consists of. Therefore, the measured thickness of the medium P serves as an indicator for judging whether recording can be carried out on the medium P with sufficiently high quality by a normal recording manner wherein the platen member 306 is not vibrated by the piezoelectric element 320. If the measured thickness of the medium P is greater than a predetermined value, the controller 330 judges that high recording quality is not obtained, and decides to apply a high-frequency alternating electric voltage to the piezoelectric element 320.

Hereunder, there will be described the operation of the printer 301 constructed as described above, by reference to the flow chart of FIG. 24. When the controller 330 generates a command signal to feed a recording medium P, the medium P is fed to a predetermined position between the recording head 302 and the platen member 306, by being nipped by the first pair of pinch rollers 317*a*, 317*b* located on the upstream side of the feeding direction. Appropriate ones of the recording wires of the recording head 202 apply impact forces to the recording medium P set in position via a printing ribbon, IR, such as an ink ribbon, so as to record a character or other image pattern on the medium P. In the event that is used a multiple-sheet recording medium P consisting of a set of superposed sheets including a non-copying top sheet and some carbon-copying sheets under the top sheet, an ink copy is produced on the top sheet and a carbon copy is produced on each carbon-copying sheet because of the impact force applied to the medium P by the recording head 302.

Figure 24:
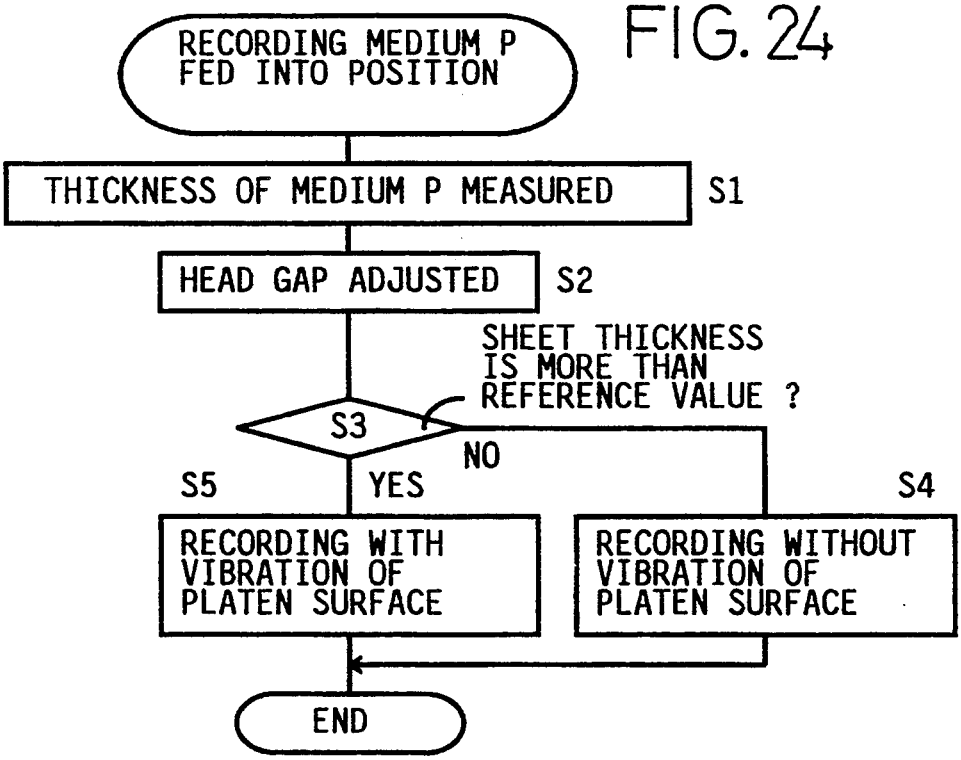
FIG. 24 is a flow chart representing the operation of the printer of FIG. 13 for measuring the thickness of a recording medium.

In Step S1 of the flow chart of FIG. 24, the controller 330 operates for measuring the thickness of the medium P by displacing the first carriage 305 or recording head 302 from the initial position toward the platen member 306 and thereby pressing the recording head 302 against the protruding portions 306*a* on the platen surface via the recording medium P. Specifically, the controller 330 counts the number of pulses supplied to the head gap adjust motor 322 for advancing the recording head 302 from the initial position to a position where the head 302 is stopped due to contact thereof with the platen surface via the recording medium P, and estimates the thickness of the medium P based on the counted number. Subsequently, in Step S2, the controller 330 operates for adjusting a gap between the recording head 302 and the platen member 306 by retracting the head 302 to a suitable position corresponding to the measured thickness of the medium P. Thus, a suitable head gap is provided before the head 302. Step S2 is followed by Step S3 in which the controller 330 identifies whether or not the measured thickness of the medium P is greater than a predetermined value. If a negative result (NO) is obtained in Step S3, the controller 330 judges that recording can be carried out on the medium P with sufficiently high quality. In this case, the control goes to Step S4 to carry out recording on the medium P without vibrating the platen member 306. On the other hand, if an affirmative result (YES) is obtained in Step S3, the controller 330 estimates that the medium P would include more than five recording sheets and therefore it would be difficult to record images on the medium with sufficiently high quality. In this case, the control of the controller 330 proceeds with Step S5 to effect recording on the medium P by vibrating the platen member 306 at an ultrasonic frequency. Specifically, the piezoelectric element 320 repetitively expands and contracts in the direction perpendicular to the operative surface of the recording head 302, and applies vibration to the platen member 306 via the flat spring 307.

When the impact force of the recording head 302 is being exerted to the recording medium P, the controller 330 operates for applying an alternating electric voltage to the piezoelectric element 320. The frequency of the vibration of the platen member 306 may be selected such that one to several cycles of vibration of the platen member 306 occur during a time duration in which the recording wires of the recording head 302 directly contact the recording medium P.

In synchronism with times of supplying of respectively batches of the recording data to the recording head 302 from a host computer (not shown), the drive shaft 314 is rotated by the drive motor 321, so that the drive pulleys 315, 316 are rotated. Consequently, the first carriage 305 supporting the recording head 302 is displaced with the first timing belt 312 along a recording surface of the recording medium P. Since the second carriage 311 supporting the platen member 306 is also connected to the drive shaft 314, the platen member 306 concurrently is displaced with the second timing belt 313 along a non-recording surface of the medium P in the same direction as the direction of displacement of the recording head 302, such that the platen surface of the platen member 306 continues to be opposed to the operative surface of the recording head 302. Since the outer diameters of the first and second drive pulleys 315, 236 are equal to each other, the rate or speed of the displacement of the platen member 306 is equal to that of the displacement of the recording head 302. As the recording head 302 is displaced along the recording surface of the recording medium P, the platen member 306 is, while being vibrated by the piezoelectric element 320, displaced along the non-recording surface of the medium P in the same direction as the direction of displacement of the recording head 302, in synchronism with the displacement of the head 302. After the recording of one character line has thus been completed on the recording medium P, the medium P is fed forward by a predetermined incremental length by the second pair of pinch rollers 318*a*, 318*b* disposed on the downstream side of the feeding direction.

When the recording wires of the recording head 302 are impacting against the recording surface of the recording medium P for recording dots as information on the medium P, the protruding portions 306*a* of the platen member 306 react to the non-recording surface of the medium P in response to the impact force of the recording wires of the head 302. In addition, the vibration of the platen member 306 is applied, when appropriate, to the medium P. Thus, a clear image is produced on each of the superposed sheets of the recording medium P down to the bottom sheet thereof. In addition, since the platen member 306 is vibrated only when appropriate, the printer 301 is operable at reduced energy cost. This leads to reducing noise generated when recording is carried out by the printer 301.

The platen device 308 used in the printer 301 shown in FIG. 21 may be replaced by a different platen device as shown in FIG. 16.

The operative ends of the recording wires of the recording head 302 and the protruding portions 306*a* provided on the platen surface of the platen member 306 may have various arrangements and shapes as shown in FIGS. 17A through 17D. In the case of FIG. 17D wherein the operative ends of the recording wires of the recording head 302 are arranged in directions different from a vertical direction, the printer 301 is equipped with means for preventing, when a head gap before the recording head 302 is adjusted, the head 302 from being moved vertically.

The protruding portions 306*a* on the platen surface of the platen member 306 may have various cross sections as shown in FIGS. 18A through 18D.

The protruding portions 306*a* may be provided on a platen surface of a platen member 306 in a manner shown in FIG. 19 in which a plate member including one or more protruding portions is fixed to the platen surface of the platen member.

While in the printer 301 shown in FIG. 21 the controller 330 decides, based on the measured thickness of the recording medium P, whether to vibrate the platen member 306, it is possible to make the decision by counting the number of superposed sheets of a multiple-sheet recording medium P, or measuring a weight of the medium P. In addition, it is possible to change a frequency of the vibration applied to the platen member 306 by the piezoelectric element 320, based on the measured thickness of the recording medium P.

In addition, the printer 301 may be equipped with a manually operable switch for commanding the controller 330 to decide to operate the piezoelectric element 320 to apply vibration to the platen member 306.

While the present invention has been described in detail in its preferred embodiments, it is to be understood that the invention is not limited to the particulars of the illustrated embodiments but may be embodied with various changes, improvements, and modifications that may occur to those skilled in the art without departing from the scope and spirit of the invention defined in the appended claims.

What is claimed is:

1. A printer for recording information on one of opposite surfaces of a recording medium, comprising:

a recording head which is displaceable along said one surface of said recording medium and records said information on said one surface of said recording medium, a platen member having a platen surface which is opposed to said recording head;

a flat spring having opposite surfaces to one of which said platen member is fixed;

a frame member supporting said flat spring;

vibration means for applying vibration to said platen member and thereby vibrating said platen surface, said vibration means comprising a piezoelectric element which is at one of opposite ends thereof fixed to said frame member and at the other end thereof fixed to the other of said opposite surfaces of said flat spring; and actuating means for, when said recording head is displaced along said one surface of said recording medium, displacing said platen member, said flat spring, said frame member and said piezoelectric element, as a unit, along the other of said opposite surfaces of said recording medium in a same direction as a direction of the displacement of said recording head and in synchronism with said displacement of said recording head, so that said platen surface continues to be opposed to said recording head.

2. The printer as set forth in claim 1, wherein said piezoelectric element vibrates at an ultrasonic frequency upon application thereto of an ultrasonic frequency alternating electric voltage.

3. The printer as set forth in claim 1, wherein said recording head includes a plurality of dot recording wires, and a plurality of actuators which press, according to recording data representative of said information, said wires against said platen surface via said recording medium and thereby record dots an said information on said one surface of said recording medium.

4. The printer as set forth in claim 3, wherein said piezoelectric element expands and contracts at least one cycle in an Impact time duration in which said dot recording wires of said recording head are pressed one time against said platen surface.

5. The printer as set forth in claim 4, wherein said piezoelectric element vibrates at an ultrasonic frequency upon application thereto of an ultrasonic frequency alternating electric voltage so that said piezoelectric element expands and contracts at least two cycles in said impact time duration.

6. The printer as set forth in claim 1, wherein said actuating means comprises:

a first carriage on which said recording head is mounted;

a first timing belt to which said first carriage is fixed;

a first drive pulley engaged with said first timing belt;

a second carriage on which said platen means is mounted;

a second timing belt to which said second carriage is fixed;

a second drive pulley engaged with said second timing belt, said second drive pulley having an outer diameter equal to an outer diameter of said first drive pulley; and a drive shaft for rotating said first and second drive pulleys together with each other, so that said platen surface continues to be opposed to said recording head.

7. A printer for recording information on one of opposite surfaces of a recording medium, comprising:

a recording head which is displaceable along said one surface of said recording medium and records said information on said one surface of said recording medium;

a flat spring having opposite surfaces one of which provides a platen surface which is opposed to said recording head;

a frame member supporting said flat spring;

vibration means for applying vibration to said flat spring and thereby vibrating said platen surface, said vibration means comprising a piezoelectric element which is at one of opposite ends thereof fixed to said frame member and at the other end thereof fixed to the other of said opposite surfaces of said flat spring; and actuating means for, when said recording head is displaced along said one surface of said recording medium, displacing said flat spring, said frame member and said piezoelectric element, as a unit, along the other of said opposite surfaces of said recording medium in a same direction as a direction of the displacement of said recording head and in synchronism with said displacement of said recording head so that said platen surface continues to be opposed to said recording head.

8. A printer for recording information on one of opposite surfaces of a recording medium, comprising:

a recording head which records said information on said one surface of said recording medium;

a platen member having a platen surface which is opposed to an operative surface of said recording head;

a piezoelectric element which vibrates upon application thereto of an electric voltage, said piezoelectric element being connected to said platen member so that the vibration of said piezoelectric element upon application of said electric voltage is transmitted to said platen member so as to vibrate said platen surface in a vibration direction intersecting said operative surface of said recording head;

preventing means for preventing said platen member from vibrating in a direction different from said vibration direction; and a frame member having a U-shaped configuration, said frame member including a pair of symmetrical arm portions and a connection portion connecting said symmetrical arm portions with each other, said preventing means connecting said platen member to said pair of arm portions of said frame member, such that the preventing means allows said platen member to vibrate only in said vibrator direction, said piezoelectric element being connected at one of opposite ends thereof to said platen member and at the other end thereof to said connection portion of said frame member.

9. The printer as set forth in claim 8, further comprising:

displacing means for displacing said recording head along said one surface of said recording medium, for recording said information on said one surface; and actuating means for, when said recording head is displaced along said one surface of said recording medium, displacing said platen member along the other of said opposite surfaces of said recording medium in a same direction as a direction of the displacement of said recording head and in synchronism with said displacement of the recording head, so that said platen surface continues to be opposed to said recording head.

10. The printer as set forth in claim 8, wherein said frame member includes, as said connection portion thereof, a first portion supporting said piezoelectric element connected to said platen member, and a pair of second portions as said pair of arm portions thereof which are spaced apart from each other in a spaced-apart direction perpendicular to said vibration direction of said platen member and each of which has opposite surfaces parallel to said spaced-apart direction and perpendicular to said platen surface, said platen member having opposite surfaces each of which is perpendicular to said platen surface and is flush with a corresponding one of the opposite surfaces of each of said second portions of said frame member, said preventing means comprising a pair of flat springs each of which is fixed at a middle portion thereof to a corresponding one of said opposite surfaces of said platen member, is fixed at one of both end portions thereof to a corresponding one of the opposite surfaces of one of said second portions of said frame member, and is fixed at the other of said both ends portions thereof to a corresponding one of the opposite surfaces of the other of said second portions of said frame member, said each flat spring having a pair of H-shaped openings each of which is formed through thickness of said each flat spring, each of said H-shaped openings being positioned between said platen member and a corresponding one of said second portions of said frame member.

11. The printer as set forth in claim 8, wherein said frame member includes, as said connection portion thereof, a first portion supporting said piezoelectric element connected to said platen member, and a pair of second portions as said pair of arm portions thereof which are provided on both sides of said platen member, respectively, said preventing means comprising a pair of generally $\pi$-shaped springs each of which is provided between said platen member and a corresponding one of said second portions of said frame member, said each $\pi$-shaped spring having a generally $\pi$-shaped cross section, and including a head portion, a pair of leg portions, and a pair of flexible intermediate portions respectively connecting said leg portions to opposite ends of said head portion, each of said flexible intermediate portions having a thickness smaller than a thickness of each of said leg portions, one of said pair of legs of said each $\pi$-shaped spring being fixed to said platen member, the other of said pair of legs of said each $\pi$-shaped spring being fixed to said corresponding one of said second potions of said frame member.

12. The printer as set forth in claim 8, wherein said recording head includes a plurality of dot recording wires, and a plurality of actuators which press, according to recording data representative of said information, said wires against said platen surface via said recording medium and thereby record dots as said information on said one surface of said recording medium.

13. The printer as set forth in claim 12, wherein said piezoelectric element vibrates in said vibration direction at an ultrasonic frequency upon application thereto of an ultrasonic-frequency alternating electric voltage, so that said piezoelectric element expands and contracts at least two cycles in an impact time duration in which said dot recording wires of said recording head are pressed one time against said platen surface.

14. A printer for recording information on one of opposite surfaces of a recording medium, comprising:

a recording head displaceable along said one surface of said recording medium, said recording head including a plurality of dot recording wires and a plurality of actuators which press said dot recording wires for recording dots as said information on said one surface of said recording medium;

a platen member having a platen surface which is opposed to said recording head;

at least one protruding portion protruding from said platen surface toward said recording head, said at least one protruding portion being aligned with said dot recording wires of said recording head, such that each of said dot recording wires is pressed by a corresponding one of said actuators against a corresponding one of said at least one protruding portion; and actuating means for, when said recording head is displaced along said one surface of said recording medium, displacing said platen member along the other of said opposite surfaces of said recording medium in a same direction as a direction of the displacement of said recording head and in synchronism with the displacement of said recording head, so that said each dot recording wire of said recording head continues to be aligned with said corresponding one of said at least one protruding portion on said platen surface.

15. The printer as set forth in claim 14, wherein said platen member comprises:

a frame member having said platen surface; and a base member including said at least one protruding portion, said base member being fixed to said platen surface of said frame member.

16. The printer as set forth in claim 14, wherein said at least one protruding portion is formed of a material selected from the group consisting of cemented carbide, tungsten, and ceramic zirconia.

17. The printer as set forth in claim 14, wherein said platen surface has at least one elongate groove formed therein, said at least one protruding portion comprising at least one elongate member each of which is partially embedded in a corresponding one of said at least one elongate groove.

18. The printer as set forth in claim 14, wherein said platen surface has a multiplicity of uniform holes formed therein in at least one array, said at least one protruding portion comprising a multiplicity of uniform members each of which is partially embedded in a corresponding one of said uniform holes, so as to provide at least one array of said uniform members on said platen surface.

19. The printer as set forth in claim 14, wherein said platen surface has a rhombic groove formed therein, said at least one protruding portion comprising a rhombic member which is partially embedded in said rhombic groove.

20. The printer as set forth in claim 14, wherein said platen member comprises a base member including said at least one protruding portion, said base member being fixed to said platen surface of said platen member.

21. The printer as set forth in claim 14, wherein said at least one protruding portion has a plane top surface which is opposed to said recording head.

22. The printer as set forth in claim 14, wherein said at least one protruding portion has a curved top surface which is opposed to said recording head.

23. The printer as set forth in claim 14, further comprising vibration member for applying vibration to said platen means and thereby vibrating said platen surface.

24. The printer as set forth in claim 14, wherein said platen member comprises:

a frame member having said platen surface; and at least one protruding member fixed to said platen surface of said frame member so as to provide said at least one protruding portion protruding from said platen surface toward said recording head.

25. A printer for recording information on one of opposite surfaces of a recording medium, comprising:

a recording head which is displaceable along said one surface of said recording medium and records said information on said one surface of said recording medium;

a platen member having a platen surface which is opposed to said recording head;

vibration means for applying vibration to said platen member and thereby vibrating said platen surface; and deciding means for deciding whether to operate said vibration means and thereby apply, while said recording head records said information an said recording medium, said vibration of the vibration means to said platen member.

26. The printer as set forth in claim 25, wherein said platen member includes at least one protruding portion protruding from said platen surface toward said recording head.

27. The printer as set forth in claim 25, wherein said deciding means comprises detecting means for detecting a physical amount relating to a thickness of said recording medium, said deciding means deciding to operate said vibration means based on the detected physical amount of said recording medium.

28. The printer as set forth in claim 25, wherein said deciding means further comprises changing means for changing a frequency of said vibration applied to said platen means by said vibration means, based on said detected physical amount of said recording medium.

29. The printer as set forth in claim 25, wherein said deciding means comprises drive means for moving said recording head toward said platen surface to measure a thickness of said recording medium, said deciding means deciding to operate said vibration means when the measured thickness of said recording medium is greater than a predetermined value.

30. The printer as set forth in claim 29, wherein said drive means comprises:

a carriage on which said recording head is mounted;

a first guide shaft which is rotatable about an axis line eccentric with a center line of said first guide shaft, said first guide shaft extending through a hole formed through said carriage;

a second guide shaft cooperating with said first guide shaft to support said carriage and permitting said carriage to move toward said platen surface; and means for rotating said first guide shaft, for moving said recording head from a reference position toward said platen surface, so as to press said recording medium against said platen surface and thereby measure the thickness of said recording medium.

31. The printer as set forth in claim 25, further comprising a manually operable switch which commands said deciding means to decide to operate said vibration means to apply said vibration to said platen member.

32. The printer as set forth in claim 25, further comprising:

displacing means for displacing said recording head along said one surface of said recording medium, for recording said information on said one surface; and actuating means for, when said recording head is displaced along said one surface of said recording medium, displacing said platen member along the other of said opposite surfaces of said recording medium in a same direction as a direction of the displacement of said recording head and in synchronism with said displacement of the recording head, so that said platen surface continues to be opposed to said recording head.

33. The printer as set forth in claim 26, wherein said recording head includes a plurality of dot recording wires and a plurality of actuators which press, according to recording data representative of said information, said wires against said platen surface via said recording medium and thereby record dots as said information on said one surface of said recording medium, said vibration means comprising a piezoelectric element which vibrates at an ultrasonic frequency upon application thereof of an ultrasonic electric voltage, said piezoelectric element being connected to said platen member, so that the ultrasonic vibration of said piezoelectric element is transmitted to said platen member so as to vibrate platen surface, said piezoelectric element expanding and contracting at least two cycles in an impact time duration in which said dot recording wires of said recording head are pressed one time against said platen surface.

34. A printer for recording information on one of opposite surfaces of a recording medium, comprising:

a recording head displaceable along said one surface of said recording medium, said recording head including a plurality of dot recording wires and a plurality of actuators which press said dot recording wires for recording dots as said information on said one surface of said recording medium;

a platen member having a platen surface which is opposed to said recording head;

at least one protruding portion protruding from said platen surface toward said recording head, said at least one protruding portion being aligned with said dot recording wires of said recording head such that each of said dot recording wires is pressed against a corresponding one of said at least one protruding portion;

vibration means for applying vibration to said platen member and thereby vibrating said platen surface, said vibration means comprising an ultrasonic vibrator which vibrates at an ultrasonic frequency upon application thereto of an ultrasonic-frequency alternating electric voltage;

actuating means for, when said recording head is displaced along said one surface of said recording medium, displacing said platen member and said ultrasonic vibrator, as a unit, along the other of said opposite surfaces of said recording medium in a same direction as a direction of the displacement of said recording head, and in synchronism with said displacement of said recording head, so that said each dot recording wire of said recording head is aligned with said corresponding one of said at least one protruding portion on said platen surface; and deciding means for deciding whether to operate said vibration means and thereby apply, while said recording head records said information on said recording medium, said vibration of the vibration means to said platen member.

35. A printer for recording information on one of opposite surfaces of a recording medium, comprising:

a recording head which records said information on said one surface of said recording medium;

a platen member having a platen surface which is opposed to an operative surface of said recording head;

a piezoelectric element which vibrates upon application thereto of an electric voltage, said piezoelectric element being connected to said platen member so that the vibration of said piezoelectric element upon application of said electric voltage is transmitted to said platen member so as to vibrate said plate surface in a vibration direction intersecting said operative surface of said recording head;

preventing means for preventing said platen member from vibrating in a direction different from said vibration direction;

displacing means for displacing said recording head along said one surface of said recording medium, for recording said information on said one surface; and actuating means for, when said recording head is displaced along said one surface of said recording medium, displacing said platen member along the other of said opposite surfaces of said recording medium in a same direction as a direction of the displacement of said recording head, and in synchronism with said displacement of the recording head, so that said platen surface continues to be opposed to said recording head.

* * * * *